US012716223B2

(12) United States Patent
Lorkowski et al.

(10) Patent No.: US 12,716,223 B2
(45) Date of Patent: Aug. 25, 2026

(54) DRAIN ASSEMBLY AND METHOD OF INSTALLATION

(71) Applicant: OATEY CO., Cleveland, OH (US)

(72) Inventors: Aaron Lorkowski, North Ridgeville, OH (US); Zhang Jian, Shanghai (CN); Alexander Meyer, Lakewood, OH (US); Matthew Siena, East Hampton, CT (US)

(73) Assignee: OATEY CO., Cleveland, OH (US)

( * ) Notice: Subject to any disclaimer, the term of this patent is extended or adjusted under 35 U.S.C. 154(b) by 794 days.

(21) Appl. No.: 17/994,941

(22) Filed: Nov. 28, 2022

(65) Prior Publication Data

US 2023/0167633 A1 Jun. 1, 2023

Related U.S. Application Data

(60) Provisional application No. 63/283,668, filed on Nov. 29, 2021.

(51) Int. Cl.
*E03C 1/20* (2006.01)
*E03C 1/22* (2006.01)

(52) U.S. Cl.
CPC . *E03C 1/20* (2013.01); *E03C 1/22* (2013.01)

(58) Field of Classification Search
CPC . F16L 15/10; F16L 25/10; F16L 25/14; F16L 17/025; E03C 1/086; E03C 1/12; E03C 1/122–1225; E03C 1/20; E03C 1/22; E03C 1/14–16; E03C 1/182; E03D 11/14; E03D 11/16–17; E03F 5/0407–0409
See application file for complete search history.

(56) References Cited

U.S. PATENT DOCUMENTS

| | | | | | |
|---|---|---|---|---|---|
| 2,051,211 | A * | 8/1936 | Hagopian | F16L 37/48 | 285/8 |
| 2,544,498 | A | 3/1951 | Hiertz | | |
| 2,688,499 | A * | 9/1954 | Hanson | F16L 37/48 | 285/8 |
| 3,913,928 | A * | 10/1975 | Yamaguchi | F16L 25/10 | 277/615 |
| 4,440,406 | A * | 4/1984 | Ericson | F16L 25/14 | 277/615 |
| 5,201,553 | A * | 4/1993 | Grisham | F16L 47/08 | 285/379 |
| 5,653,452 | A * | 8/1997 | Jarvenkyla | F16L 47/08 | 285/345 |
| 6,381,775 | B1 | 5/2002 | Sondrup | | |
| 9,551,138 | B2 | 1/2017 | Mcleod et al. | | |
| 10,385,557 | B2 | 8/2019 | Mcleod et al. | | |

(Continued)

FOREIGN PATENT DOCUMENTS

| | | | | |
|---|---|---|---|---|
| FI | 63094 | * 12/1982 | E03D 11/16 | |
| NL | N8801130 | * 11/1989 | F16K 27/12 | |

*Primary Examiner* — David P Angwin
*Assistant Examiner* — Nicholas A Ros
(74) *Attorney, Agent, or Firm* — Baker Hostetler

(57) ABSTRACT

A drain assembly for connecting an island tub to a drainpipe is disclosed. The assembly accommodates tailpipes of different sizes and comprises a gasket disposed at least partially within a gasket chamber. The gasket has a first sealing portion being engageable with an end of a first tailpipe to create a fluid seal therebetween, and a second sealing portion being engageable with an outer surface of a second tailpipe to create a fluid seal therebetween.

21 Claims, 21 Drawing Sheets

(56) References Cited

U.S. PATENT DOCUMENTS

| | | | | |
|---|---|---|---|---|
| 10,465,370 | B2 | 11/2019 | Donnelly | |
| 11,168,467 | B2 * | 11/2021 | Xinkun | E03C 1/20 |
| 2007/0017022 | A1 * | 1/2007 | Mayer | E03C 1/20 4/650 |
| 2017/0058498 | A1 * | 3/2017 | Castellote | E03C 1/20 |
| 2018/0045344 | A1 * | 2/2018 | Cloutier | E03C 1/20 |
| 2020/0011043 | A1 | 1/2020 | Donnelly | |

* cited by examiner

DRAIN ASSEMBLY AND METHOD OF INSTALLATION

CROSS-REFERENCE TO RELATED APPLICATIONS

This application claims the benefit of U.S. Provisional Application No. 63/283,668, filed Nov. 29, 2021, the entire contents of which are incorporated herein by reference.

TECHNICAL FIELD

This disclosure relates generally to a drain assembly, and more particularly, to a drain assembly that can receive various sized pipes.

BACKGROUND

There has been a recent trend in bathroom design and remodel that includes installing an island or free-standing tub. The process of plumbing the free-standing or island tub can work in a similar way as a regular bath tub drain. The plumbing can include water inlets for hot and cold water and a drain assembly for the water exiting the tub.

Island tubs include tailpipes connected to a drain in the base of the tub to drain water. The tailpipe is connected to a drainpipe in the floor via the drain assembly. Tailpipes can come in different sizes (e.g. pipe diameters) for which drain assemblies need to accommodate in order to effectively drain water from the tub. Typically, a plumber uses a drain assembly sized specifically for a tailpipe or needs to include additional components or parts to ensure the tailpipe is fluidly connected to the drainpipe. Also, plumbers typically need to ensure the tailpipe is axially aligned with the drainpipe or otherwise additional sealing may be required. As such, to properly connect the island tub to a drainpipe can be time consuming and can require additional components and/or equipment to ensure effective drainage.

The information included in this Background section of the specification, including any references cited herein and any description or discussion thereof, is included for technical reference purposes only and is not to be regarded as subject matter by which the scope of the invention is to be bound.

SUMMARY

The foregoing needs are met, to a great extent, by the drain assembly disclosed in the present application. The drain assembly is configured to receive different sized tailpipes for connecting an island tub to a drainpipe, which simplifies the rough-in and tub placement for island tubs.

The present disclosure provides multiple aspects of a drain assembly for connecting an island tub to a drain pipe. For example, in one aspect the island tub has a first tailpipe with a first outer diameter or a second tailpipe with a second outer diameter that is less than the first outer diameter. The assembly comprises a drain body and a gasket. The drain body is attachable to and fluidly connectable with the drainpipe. The drain body includes a body sidewall extending from a first end to a second end. The sidewall has an inner surface that defines a gasket chamber within the drain body. The gasket is disposed at least partially within the gasket chamber. The gasket has a first sealing portion being engageable with an end of the first tailpipe to create a fluid seal therebetween. The gasket also has a second sealing portion being engageable with an outer surface of the second tailpipe to create a fluid seal therebetween.

In another aspect of a drain assembly for connecting an island tub to a drainpipe, the island tub has a first tailpipe with a first outer diameter or a second tailpipe with a second outer diameter that is less than the first outer diameter. The drain assembly comprises a drain body and a gasket. The drain body is attachable to and fluidly connectable with the drainpipe. The drain body includes a body sidewall that extends from a first end to a second end. The body sidewall has an inner body surface that extends from the first end to the second end. The inner body surface defines a gasket chamber. The gasket is disposed at least partially within the gasket chamber. The gasket includes an inner wall that extends from a first gasket end to a second gasket end. The inner wall has a first gasket portion and a second gasket portion. The first gasket portion defines a first gasket diameter, and the second gasket portion defines a second gasket diameter that is smaller than the first gasket diameter. The first gasket portion is engageable with an outer surface of the first tailpipe, and the second gasket portion is engageable with an outer surface of the second tailpipe.

In another aspect of a drain assembly for connecting an island tub to a drainpipe, the island tub has a first tailpipe with a first outer diameter or a second tailpipe with a second outer diameter that is less than the first outer diameter. The assembly comprises a drain body and a gasket. The drain body is attachable to and fluidly connectable with the drainpipe. The drain body includes a body sidewall and a projection. The body sidewall extends from a first end to a second end and has an inner body surface that defines a gasket chamber within the drain body. The projection extends radially inward from the body sidewall, and defines a bottom end of the gasket chamber. The bottom end includes an opening formed therethrough. The gasket is disposed at least partially within the gasket chamber such that a portion of the gasket abuts against the projection of the drain body and another portion of the gasket extends at least partially through the opening. The gasket is engageable with an end of the first tailpipe to create a fluid seal therebetween. The gasket is further engageable with an outer surface of the second tailpipe to create a fluid seal therebetween.

In another aspect, the present disclosure provides a gasket for a drain assembly for connecting an island tub to a drainpipe. The island tub has a first tailpipe with a first outer diameter or a second tailpipe with a second outer diameter that is less than the first outer diameter. The drain assembly includes a drain body having a gasket chamber. The gasket is at least partially positioned within the gasket chamber. The gasket comprises a gasket sidewall that extends from a first gasket end to a second gasket end. The gasket sidewall has an inner gasket surface that defines a first gasket portion and a second gasket portion. The first gasket portion defines a first gasket diameter, and the second gasket portion defines a second gasket diameter that is less than the first gasket diameter. The first gasket portion is engageable with an outer surface of the first tailpipe, and the second gasket portion is engageable with an outer surface of the second tailpipe.

In another aspect of a drain assembly to connect an island tub to a drainpipe, the drain assembly comprises a drain body, a gasket, and a removable plug. The drain body includes a body sidewall, a plurality of upper locking projections, and a plurality of lower locking projections. The body sidewall extends from a top end to a bottom end. The body sidewall has an inner body surface that defines a drainage channel that extends from the top end to the bottom end. The plurality of upper locking projections extends radially inward from the body sidewall. The plurality of lower locking projections extends radially inward from the body sidewall. The lower locking projections are spaced from the plurality of upper locking projections toward the bottom end of the body sidewall. The gasket is positioned within the drain body and located immediately adjacent to the plurality of lower locking projections. The gasket has a first opening adjacent to the plurality of lower locking projections and an opposing second opening positioned adjacent to the bottom end of the body sidewall of the drain body. The removable test plug includes a plug body, a grip member, and a plurality of plug locking projections. The grip member extends axially from an upper end of the plug body. The plurality of plug locking projections extend radially outward from the plug body. The plug body of the test plug is insertable into the first opening of the gasket to prevent fluid flow through the drainage channel and is rotatable between a first operative position and a second operative position. In the first operative position the upper and lower locking projections of the drain body are positioned between adjacent plug locking projections of the test plug. In the second operative position the upper and lower locking projections of the drain body are positioned adjacent to opposing surfaces of each plug locking projection such that axial movement of the test plug within the drainage channel is substantially prevented.

In another aspect of a drain assembly to connect an island tub to a drainpipe, the drain assembly comprises a drain body and a protective cap. The drain body includes a body sidewall that extends from a top end to a bottom end. The body sidewall has an inner body surface that defines a drainage channel that extends through the drain body from an inlet at the top end to an outlet at the bottom end. The body sidewall includes a shoulder located between the top end and the bottom end. The protective cap is insertable into the drainage channel until a bottom cap end of the protective cap abuts against the shoulder of the drain body. The protective cap is sized such that when the protective cap abuts against the shoulder of the drain body the protective cap extends through the inlet of the drain body to a height above the drain body.

In another aspect of a drain assembly to connect an island tub to a drainpipe, the drain assembly comprises a drain body and a gasket. The drain body has an upper end that defines an upper drain opening and a lower end that defines a lower drain opening. The lower end is spaced from the upper end along a drain axis. The drain body defines a drainage channel between the upper and lower drain openings. The drain body includes a drain portion, a gasket body, and a drain connector. The gasket body extends from the drain portion. The drain connector extends from the gasket body. The drain portion, the gasket body, and the drain connector are integrally formed together. The gasket is positioned within the gasket chamber of the drain body.

This Summary is provided to introduce a selection of concepts in a simplified form that are further described below in the Detailed Description section. This Summary is not intended to identify key features or essential features of the claimed subject matter, nor is it intended to be used to limit the scope of the claimed subject matter. Furthermore, the claimed subject matter is not constrained to limitations that solve any or all disadvantages noted in any part of this disclosure.

BRIEF DESCRIPTION OF THE DRAWINGS

The foregoing summary, as well as the following detailed description, are better understood when read in conjunction with the appended drawings. In the drawing, for purposes of explanation, numerous specific details are set forth in order to provide an understanding of the variations in implementing the disclosed technology. However, the instant disclosure may take many different forms and should not be construed as limited to the specific examples disclosed in the drawings. When practical, like numbers refer to like elements throughout. In the drawings.

DETAILED DESCRIPTION

Figure 1:
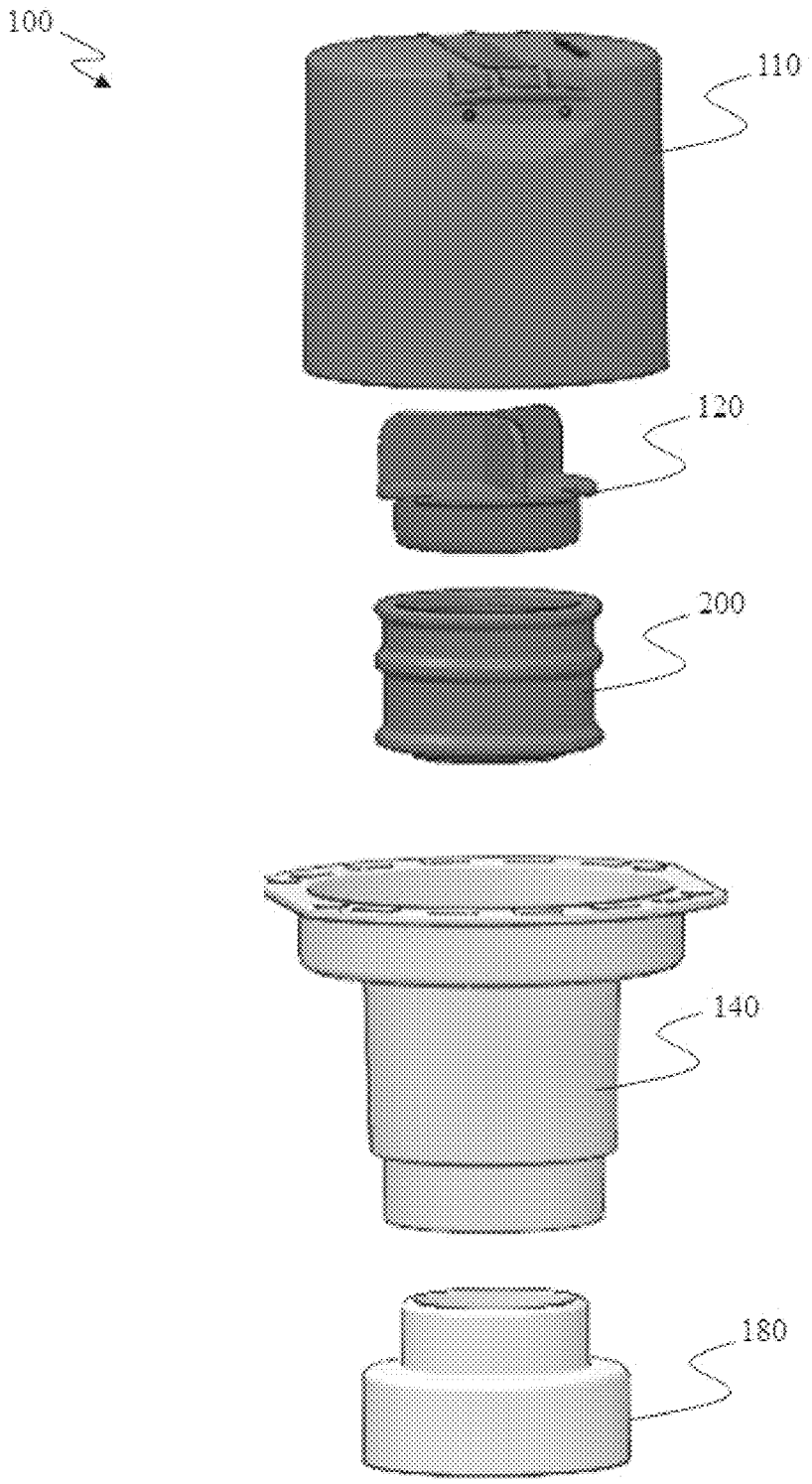
FIG. 1 is an exploded view of a drain assembly, according to an aspect of this disclosure.

Certain terminology used in this description is for convenience only and is not limiting. The words "axial", "radial", "outward", "inward", "upper," and "lower" designate directions in the drawings to which reference is made. The term "substantially" is intended to mean considerable in extent or largely but not necessarily wholly that which is specified. All ranges disclosed herein are inclusive of the recited endpoint and independently combinable (for example, the range of "from 2 grams to 10 grams" is inclusive of the endpoints, 2 grams and 10 grams, and all the intermediate values). The terminology includes the above-listed words, derivatives thereof and words of similar import.

FIG. 1 is an exploded view of a drain assembly 100, according to an aspect of this disclosure. The drain assembly 100 includes a removable protective cap covering 110, a removable test plug 120, a gasket 200, a drain body 140, and an optional adapter 180. It will be appreciated that the drain assembly 100 can include other components including for example, bolts/fasteners, seals, conduits, extenders, or still other components to facilitate use of the drain assembly 100. During installation, a flange of the upper drain body 140 is fastened to a subfloor. The drain body 140 is configured to receive a tailpipe from a bathtub (e.g. an island tub), and further configured to be attachable and fluidly connect to a drainpipe to facilitate a flow of wastewater from the bathtub to the drainpipe, as further described herein. The drain assembly 100 can be configured to comply with relevant plumbing standards, including the ASME A112.18.2-2015/CSA B125.2-15 standard.

Figure 2A:
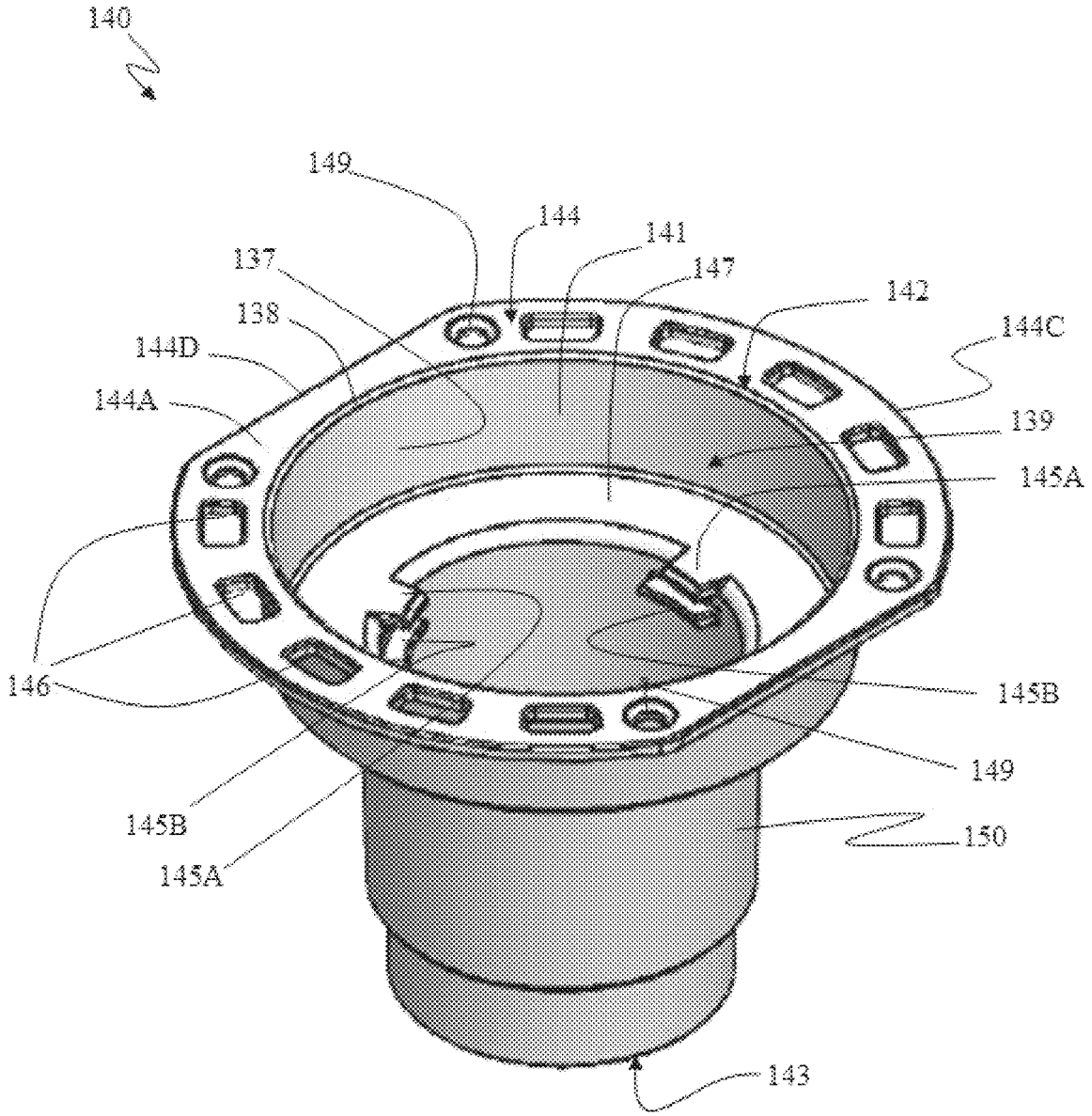
FIG. 2A is a perspective view of the upper drain body, lower drain body, and hub of the drain assembly illustrated in FIG. 1.
Figure 2B:
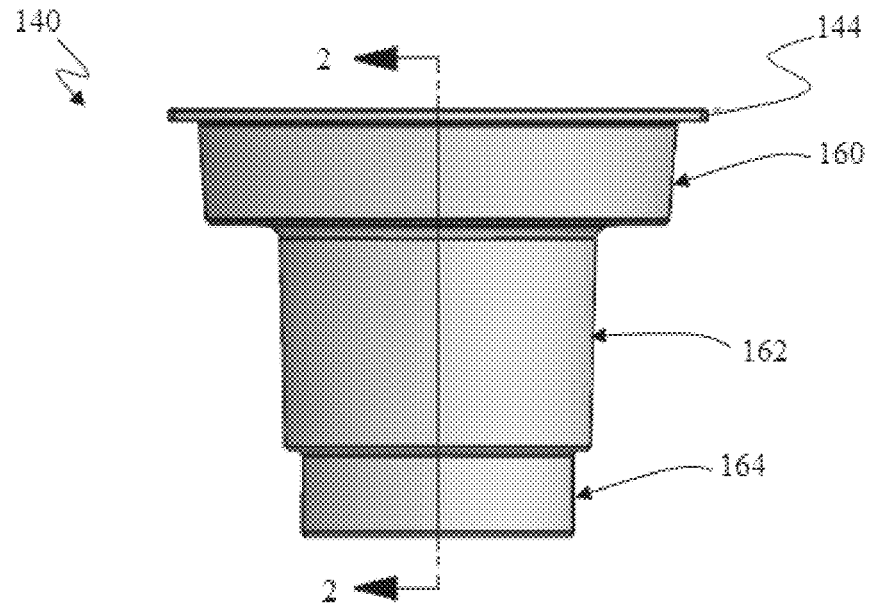
FIG. 2B is a front view of the upper drain body, lower drain body, and hub of the drain assembly illustrated in FIG. 2A.
Figure 2C:
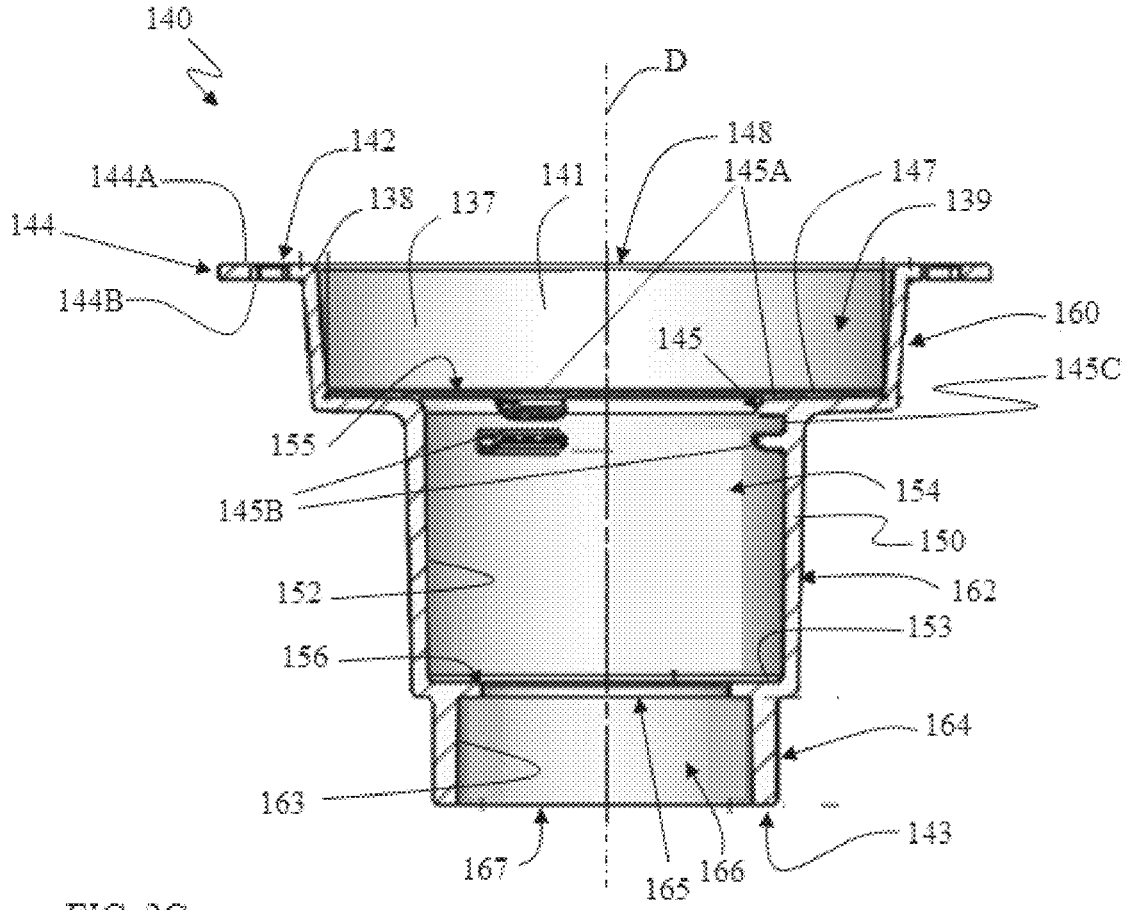
FIG. 2C is a cross-section view of the upper drain body, lower drain body, and hub of the drain assembly illustrated in FIG. 2A, such cross-section been taken along lines 2C-2C, as shown in FIG. 2B.

FIG. 2A illustrates a perspective view of the drain body 140, FIG. 2B illustrates a side view of the drain body 140, and FIG. 2C illustrates a cross-sectional view of the drain body 140 taken along line 2-2 shown in FIG. 2B. The drain body 140 can form a single part (e.g. formed as a single integrated unitary part) comprising a homogeneous material suitable for plumbing applications. For example, the drain body 140 can comprise a polyvinylchloride (PVC) material. In another example, the drain body 140 can comprise an acrylonitrile butadiene styrene (ABS) material.

The drain body 140 includes a drain portion 160, a gasket body 162, and a drain connector 164. The drain portion 160 can define a first end 142 (e.g. an upper end) of the drain body 140. The gasket body 162 extends from the drain portion 160 along a drain axis D. The drain connector 164 extends from the gasket body 162 along the drain axis D and defines a second end 143 (e.g. a lower end) of the drain body 140. In this embodiment, the drain portion 160, the gasket body 162, and the drain connector 164 are integrally formed together.

The drain body 140 further includes a first flange 144 (e.g. upper flange) and a body sidewall 150 that extends from the first flange 144 at the first end 142 of the drain body 140 to the second end 143 of the drain body 140. The first end 142 being spaced from the second end 143 by along the drain axis D. The body sidewall 150 has an inner surface 141 that extends between the first and second ends 142 and 143. The body sidewall 150 comprises a first sidewall 137, a second flange 147 (e.g. lower flange or shoulder), a second sidewall 152, a third flange 153, and a third sidewall 163.

The drain portion 160 comprises the first flange 144, the first sidewall 137, and the second flange 147. The first sidewall 137 extends from a first edge 138 of the inner surface 141 to the second flange 147. In an aspect, a diameter of the first sidewall 137 decreases as it extends from the first edge 138 toward the second flange 147. The first edge 138 defines a first opening 148 (e.g. upper drain opening) of the drain body 140. The second flange 147 extends at least partially radially inward from the first sidewall 137.

The first sidewall 137 and the second flange 147 of the drain portion 160 define a recess 139 within the drain body 140. In an aspect, the first sidewall 137 can form an inwardly-sloping frustoconical shape, such that a diameter of the first opening 148 is greater than a diameter at the intersection of the first sidewall 137 and the second flange 147. In an aspect, the second flange 147 is substantially perpendicular to the first opening 148.

The flange 144 (e.g. upper flange) is horizontally disposed that extends radially outwardly from the first end 142 of the drain body 140. The flange 144 can extend radially outwardly by a predetermined distance so as to create a curved flange edge 144C. In an aspect, the flange 144 can extend by the predetermined distance around an entire circumference of the first end 142 of the drain body 140, thereby creating a substantially circular flange. Additionally, or alternatively, as illustrated in FIG. 2A, one or more portions of the flange 144 can extend radially outwardly from the first end 142 to form a straight flange edge 144D.

In an aspect, the flange 144 can include a separate component that is connected to the first sidewall 137 of the drain body 140 by for example, screws, welding, glue, or still other connecting means. Alternatively, the drain body 140 and the flange 144 can be integrally formed together.

The flange 144 includes a top surface 144A and an opposing bottom surface 144B. The flange bottom surface 144B is configured to abut a subfloor S (See FIGS. 7A and 7B) when the drain assembly 100 is installed.

The flange 144 can include a plurality of holes 149 for receiving fasteners to attach the flange 144 to the subfloor S. The holes 149 may be beveled on the top of the flange to flushly receive a head of a fastener. In an aspect, the flange 144 also includes a plurality of spaced-apart openings 146. The openings 146 are configured to receive thinset or mortar that provides a base for floor tiles being positioned immediately adjacent to (or in abutment with) the flange 144.

The gasket body 162 comprises the second sidewall and the third flange 153. The second sidewall 152 extends from the second flange 147 toward the second end 143 of the drain body 140 at least partially along the drain axis D. The third flange 153 extends at least partially radially inward toward the drain axis D from the second sidewall 152. The drain connector 164 comprises the third sidewall 163. The third sidewall 163 extends from the third flange 153 to the second end 143 of the drain body 140.

The intersection of the second flange 147 and the second sidewall 152 defines a substantially circular second opening 155. The second opening 155 extends about the drain axis D. In an aspect, the second sidewall 152 of the drain body 140 can include a first locking feature 145 that extends radially inward. The first locking feature 145 (e.g. locking mechanism) is configured to mate with a second locking feature (e.g. plug locking mechanism) of the removable test plug 120, as further described below. The first locking feature 145 can be circumferentially positioned around the second sidewall 152 proximate the second opening 155. The second opening 155 is sized, for example, to accept a tailpipe from a bathtub.

In an aspect, the first locking feature 145 extends from the second flange 147 of the drain portion 160. For example, the drain portion 140 can include the first locking feature 145. The second sidewall 152 can extend from below the first locking feature 145 to the third flange 153.

In an aspect, the first locking feature 145 comprises a plurality of upper projections 145A and a plurality of lower projections 145B. The upper projections 145A can be disposed substantially flush with the second flange 147 and can extend radially inward from the second sidewall 152. Alternatively, the upper projections 145A can extend upward toward the first end 142 of the drain body 140. In an aspect, the upper projections 145A can extend at least partially into the recess 139 of the drain body 140. The lower projections 145B may be disposed a predetermined distance below the upper projections 145A along the drain axis D. The lower projections 145B extend radially inwardly from the second sidewall 152, so as to create a channel 145C between corresponding upper and lower projections 145A and 145B. The channel 145C is shaped to receive a mating second locking feature of the test plug 120, as further described below.

Figure 2D:
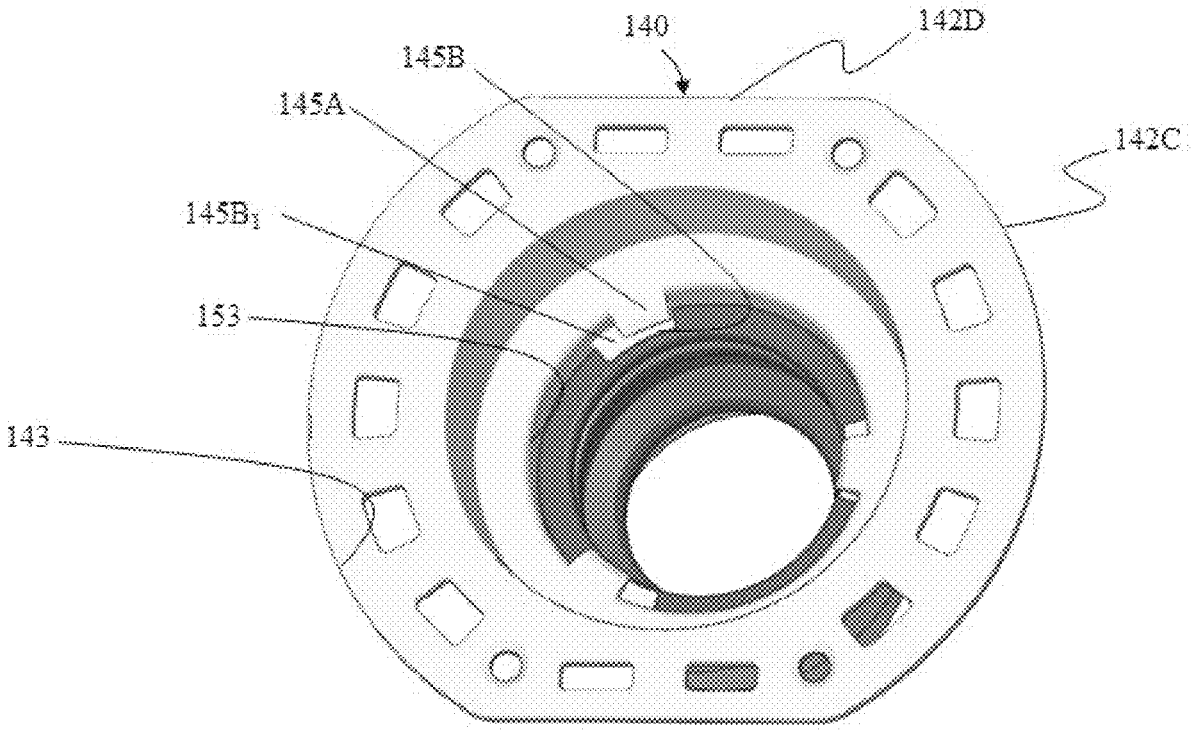
FIG. 2D is a top perspective view illustrating features of the upper drain body and gasket of the drain assembly illustrated in FIG. 1.
Figure 2E:
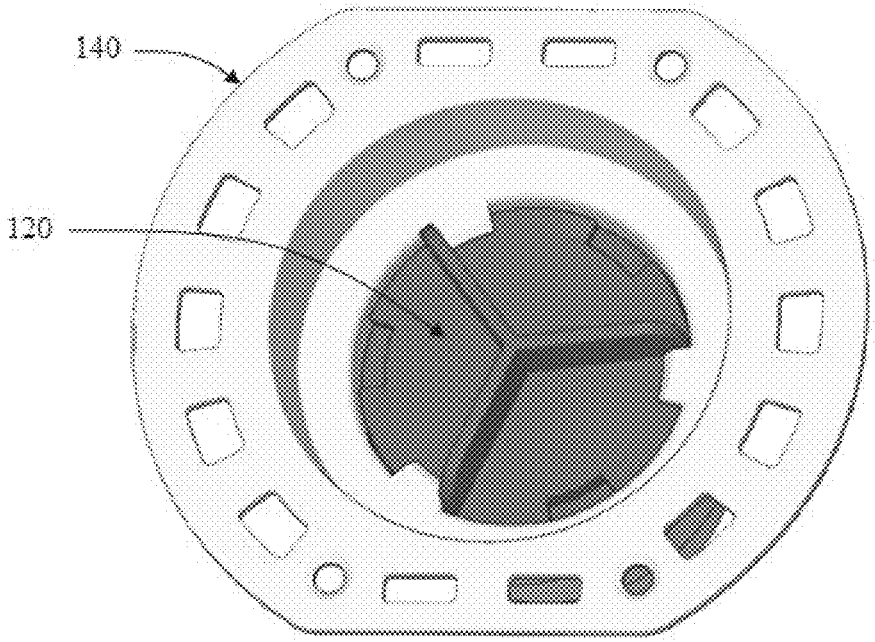
FIG. 2E is a top perspective view illustrating features of the upper drain body and removable test plug of the drain assembly illustrated in FIG. 1A.

FIG. 2D illustrates a top perspective view of the drain body 140 without the test plug 120 positioned within, and FIG. 2E illustrates a top perspective view of the drain body 140 with the test plug 120 positioned within and locked to the drain body 140. In an aspect, the upper projections 145A extend a first distance circumferentially around the third flange 153, and the lower projections 145B extend a second distance circumferentially about the third flange 153. In an aspect, the second distance is greater than the first distance, such that the lower projections 145B are circumferentially longer than, and extend beyond, the upper projections 145A. In such case, the portion of the lower projection 145$B_1$ that extends beyond the upper projection may function as a location feature for receiving the removable test plug 120.

Referring again the FIG. 2C, at an intersection of the third flange 153 and the third sidewall 163, the inner surface 141 of the drain body 140 defines a third opening 165. The lower projections 145B of the first locking feature 145, second sidewall 152, and the third flange 153 define a gasket chamber 154 within the gasket body 162. The gasket chamber 154 extends between the lower projections 145B and the third opening 165 along the drain axis D. The gasket chamber 154 is sized to receive the gasket 200 within. The third flange 153 is positioned to retain the gasket 200 within the gasket chamber 154 such that the gasket 200 can be substantially prevented from translating along the drain axis D toward the second end 143 of the drain body 140. In an aspect, a diameter of the third opening 165 is less than a diameter of the second opening 155.

The third sidewall 163 can include a retention projection 156 (e.g. protrusion) that extends radially inward from the third sidewall 163. In an aspect, the retention projection 156 can be disposed substantially flush with and protrude radially inward from the third flange 153. In another or alternative aspect, the retention projection 156 can extend circumferentially about the drain axis D to define the third opening 165. For example, an inner edge of the retention projection 156 can define the third opening 165. The retention projection 156 is sized to further prevent the gasket 200 from translating out of the gasket chamber 154 toward the second end 143 of the drain body 140. In an aspect, a diameter defined by the retention projection 156 is less than a diameter of the second sidewall 152.

The third sidewall 163 can define a substantially cylindrical receiving channel 166. The third sidewall 163 of the drain body 140 is attachable and fluidly connectable with a drain pipe 170 (See FIG. 7A). The receiving channel 166 of the drain connector 164 is sized to connect to the drainpipe 170 positioned below the drain body 140 when the drain body 140 is positioned on the subfloor S (See FIGS. 7A and 7B). In an aspect, an inner diameter of the third sidewall 163 can be sized to be slightly greater than an outside diameter of the drainpipe 170 received within the receiving channel 166. For example, when the drainpipe 170 comprises a plastic material (e.g., polyvinylchloride (PVC) or acrylonitrile butadiene styrene (ABS)), the inner diameter of the third sidewall 163 can be sized to permit the third sidewall 163 to be solvent bonded (e.g. with solvent cement) to the plastic drainpipe 170.

The third sidewall 163 extends from the third flange 153 to a fourth opening 167 (e.g. lower drain opening) at the second end 143 of the drain body 140. The inner surface 141 defines a drainage channel through the drain body 140 from the first opening 148 to the fourth opening 167 through both of the second and third openings 155 and 165. In an aspect, the third sidewall 163 can include threads (See FIG. 18). For example, if the drainpipe 170 includes outer threads, the outer threads of the drainpipe 170 can threadedly connect to the threads on the third sidewall 163 to secure the drain body 140 to the drainpipe 170. A bottom end of the third sidewall 163 forms the second end 143 of the drain body 140 and defines the fourth opening 167.

As noted herein, in certain embodiments, the drain body 140 is an integrated unitary single part. For example, the inner surface 141 of the drain body 140 extends continuously from the first end 142 to the second end 143 such that there are no breaks or intersections in the drainage channel from the first opening 148 to the fourth opening 167.

Figure 3A:
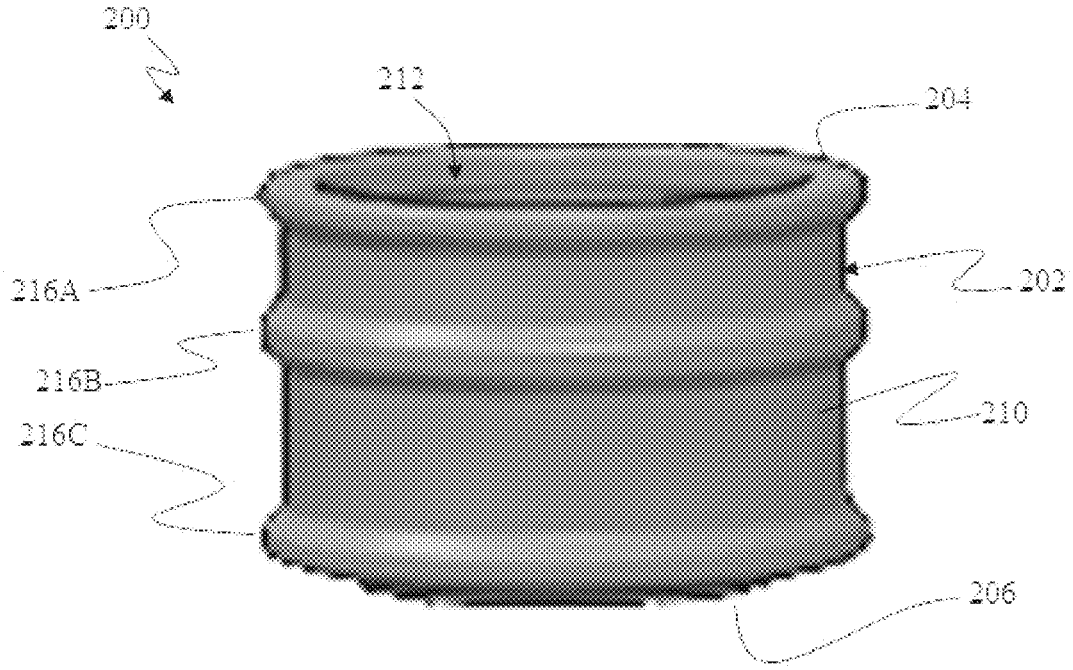
FIG. 3A is a perspective view of a gasket according to an embodiment.
Figure 3B:
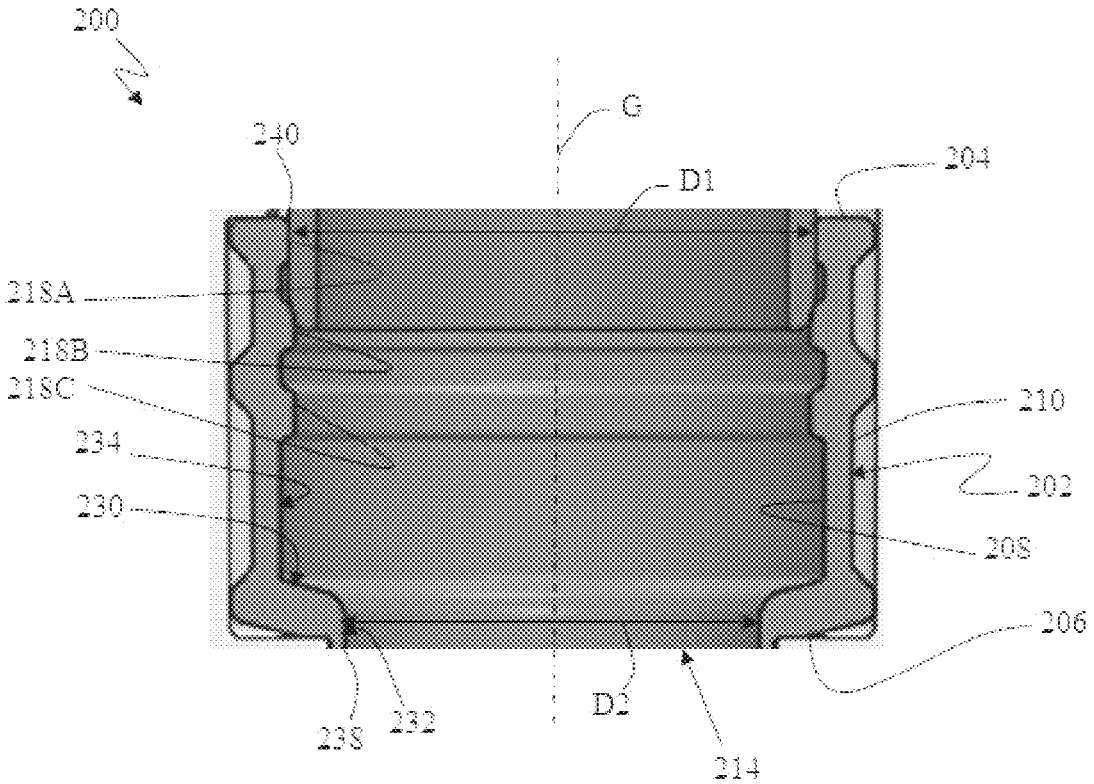
FIG. 3B is a cross-section view of the gasket illustrated in FIG. 3A.

FIGS. 3A and 3B illustrate a perspective view and cross-sectional view of a gasket 200 of the drain assembly 100, according to an aspect of this disclosure. The gasket 200 can include a substantially cylindrical structure. The gasket 200 includes a gasket sidewall 202 that extends from a first gasket end 204 to a second gasket end 206 along a gasket axis G. The gasket sidewall 202 includes a gasket inner surface 208 and an opposing gasket outer surface 210. The gasket inner surface 208 defining a gasket flow channel that extends through the gasket 200 from a first gasket opening 212 at the first gasket end 204 to a second gasket opening 214 at the second gasket end 206.

The gasket 200 can include a plurality of external protrusions 216A, 216B, and 216C that extend radially outwardly from the gasket outer surface 210. In an aspect, the plurality of external protrusions 216A, 216B, and 216C may each have a substantially similar profile. For example, the profile may be substantially hemispherical such that the plurality of external protrusions 216A, 216B, and 216C form parallel curved rings extending outwardly from respective locations along the gasket outer surface 210. In another aspect, one or more of the external protrusions 216A, 216B, and 216C can have a different profile than the other of the one or more external protrusions 216A, 216B, and 216C. It will be appreciated that the gasket 200 can include fewer or more external protrusions than illustrated in FIGS. 3A and 3B.

The plurality of external protrusions 216A, 216B, and 216C can be configured to engage the second sidewall 152 of the drain body 140 to form a fluid seal (See FIGS. 6A and 6B) when the gasket 200 is positioned within the gasket chamber 154. In an aspect, the gasket 200 can be configured to expand radially outwardly when the tailpipe 302 is positioned within the gasket 200 to sandwich the gasket sidewall 202 between the drain body 140 and an outer surface of the tailpipe 302 (See FIG. 7A). The radial expansion of the gasket sidewall 202 and compression of the sidewall 202 against the second sidewall 152 of the drain body 140 can increase the fluid seal between the gasket 200 and the drain body 140.

The gasket 200 can include a plurality of internal protrusions or ribs 218A, 218B, and 218C that extend radially inwardly from the gasket inner surface 208. In an aspect, the plurality of internal ribs 218A, 218B, and 218C may have a substantially similar profile. For example, the profile may be substantially hemispherical such that the plurality of internal ribs 218A, 218B, and 218C form parallel ribs extending inwardly from respective locations along the gasket inner surface 208. In another aspect, one or more of the internal ribs 218A, 218B, and 218C can have different profiles from each of the other internal ribs 218A, 218B, and 218C. The plurality of internal ribs 218A, 218B, and 218C can be configured to engage the outer surface of the tailpipe 302 (See FIGS. 7A and 7B). It will be appreciated that the the internal ribs 218A, 218B, and 218C can include other profiles that are shaped and configured to engage the outer surface of the tailpipe 302. It will be further appreciated that the gasket 200 can include fewer or more internal ribs than illustrated in FIGS. 3A and 3B.

The internal ribs 218A, 218B, and 218C can have similar cross-sectional dimensions. For example, a diameter of the internal rib 218A can be the same as diameters of the internal ribs 218B and 218C. Alternatively, the internal ribs 218A, 218B, and 218C can have increasing cross-sectional dimensions. For example, a diameter of the internal rib 218A can be less than a diameter of the internal protrusion 218B, which can be less than a diameter of the internal protrusion 218C. The internal ribs 218A, 218B, and 218C can facilitate the engagement and contact between various sized tailpipes 302 inserted into the drain assembly 100.

With reference to FIG. 3B, the inner surface 208 of the gasket 200 defines a first sealing portion 230, a second sealing portion 232, and a third sealing portion 234. The second sealing portion 232 extends from a inner sealing edge 238 at the second end 206 of the gasket 200 to the first sealing portion 230 along the gasket axis G. The second sealing portion 232 further extends circumferentially about the gasket axis G. The inner sealing edge 238 at the second end 206 of the gasket 200 defines the second opening 214 of the gasket 200. It will be appreciated that the second sealing portion 232 can be spaced from the second opening 214 such that the second sealing portion 232 is positioned between the first end 204 and the second end 206 of the gasket 200. The inner sealing edge 238 of the second sealing portion 232 is engageable with the outer surface of a tailpipe 302B to create a fluid seal therebetween (See FIG. 7B).

The third sealing portion 234 defines a first gasket portion, and the first and second sealing portions 230 and 232 define a second gasket portion. In an aspect, the second gasket portion is L-shaped. The first gasket portion defines a first gasket diameter D1 and the second gasket portion defines a second gasket diameter D2. The second gasket diameter D2 is less than the first gasket diameter D1.

The first sealing portion 230 extends at least partially radially outward from the second sealing portion 232. The inner surface 208 of the first sealing portion 230 extends circumferentially about the gasket axis G. The inner surface 208 of the first sealing portion 230 is engageable with an end of a tailpipe 302A to create a fluid seal therebetween (See FIG. 7A). In an aspect, the inner surface 208 of the first sealing portion 230 extends radially outward from the inner sealing edge 238 of the second sealing portion 232.

The third sealing portion 234 extends from the first end 204 toward the first sealing portion 230 along the gasket axis G. The inner surface 208 of the third sealing portion 234 extends circumferentially about the gasket axis G. In an aspect, the third sealing portion 234 extends from a first edge 240 at the first end 204 of the gasket 200 to the first sealing portion 230 along the gasket axis G. The first edge 240 at the first end 204 of the gasket 200 defines the first opening 212 of the gasket 200. It will be appreciated that the third sealing portion 234 can be spaced from the first opening 212 and/or the first sealing portion 230 along the gasket axis G such that the third sealing portion 234 is positioned axially between the first end 204 and the first sealing portion 230. The third sealing portion 234 is engageable with the outer surface of the tailpipe 302 when the end of the tailpipe 302 is engaged with the first sealing portion 230 to form a fluid seal therebetween. The third sealing portion 234 can include the plurality of internal ribs 218A, 218B, and 218C axially spaced along the inner gasket surface 208. The plurality of internal ribs 218A, 218B, and 218C are engageable with the outer surface of the tailpipe 302 when the end of the tailpipe 302 is engaged with the first sealing portion 230 to form a fluid seal therebetween. In an aspect, the third sealing portion 234 includes three internal ribs.

The inner surface 208 of the third gasket portion 234 defines a first gasket diameter. The inner surface 208 of the second gasket portion 232 defines a second gasket diameter that is smaller than the first gasket diameter. The different sized first and second gasket diameters allows the gasket 200 to seal against different sized tailpipes 302, as further described below.

The gasket 200 is positionable at least partially within the gasket chamber 154 defined by the gasket body 162 of the drain body 140. In an aspect, the gasket 200 is at least partially secured within the gasket chamber 154 by the lower projections 145B extending radially inward from the inner surface 141 of the drain body 140. The gasket 200 is further at least partially secured within the gasket chamber 154 by the third flange 153. For example, when the gasket 200 is positioned within the gasket chamber 154, the first end 204 of the gasket 200 can abut against the lower projections 145B, and the second end 206 of the gasket 200 can abut against the third flange 153. The lower projections 145B can prevent the gasket 200 from moving toward the first end 142 of the drain body 140 through the second opening 155, and the third flange 153 can prevent the gasket 200 from moving toward the second end 143 of the drain body 140 through the third opening 165, such that the gasket 200 is removably retained within the gasket chamber 154.

Figure 7A:
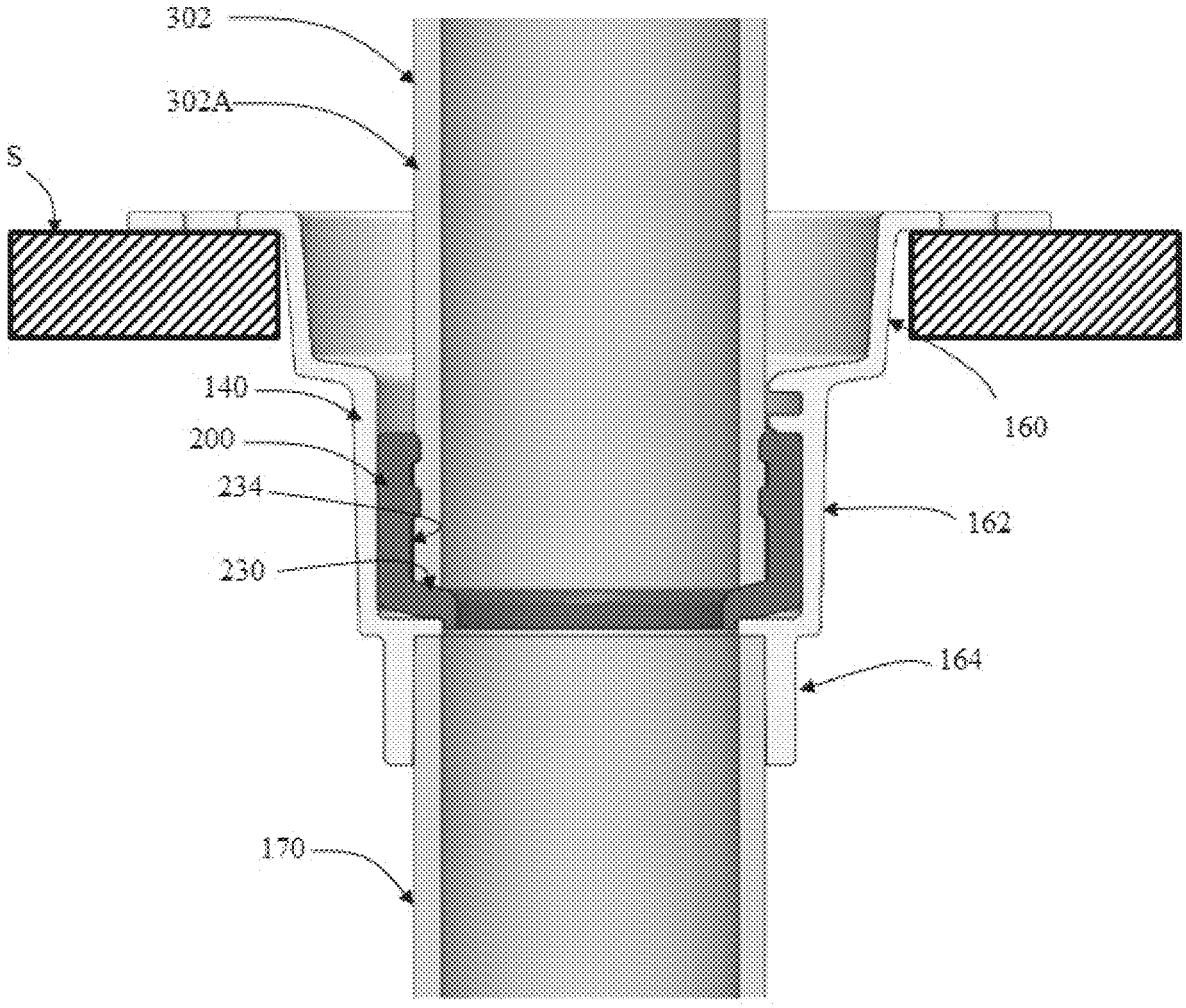
FIG. 7A is a cross-sectional view illustrating an installation of a drain assembly according to an aspect of this disclosure.

FIG. 7A illustrates a cross-sectional view of the drain body 140 with the gasket 200 positioned within the gasket chamber 154, and the tailpipe 302 positioned within the gasket 200, according to an aspect of this disclosure. The gasket chamber 154 is sized to receive at least a portion of the tailpipe 302 within. The tailpipe 302 can extend from, for example, an island bathtub. The gasket 200 is configured such that the first gasket portion 230 engages an end of a first type of tailpipe 302A. The first type of tailpipe 302A can comprise plastic tubing (e.g., polyvinylchloride (PVC) or acrylonitrile butadiene styrene (ABS)). When the first type of tailpipe 302A is inserted into the gasket 200, the first gasket portion 230 is sandwiched between the end of the tailpipe 302A and the third flange 153 of the drain body 140. In an aspect, when the end of the first type of tailpipe 302A is engaged with the first gasket portion 230, the third gasket portion 234 can engage an outer surface of the first type of tailpipe 302A. The engagements between the the first and third gasket portions 230 and 234 create a fluid seal between the tailpipe 302A and the gasket 200.

Figure 7B:
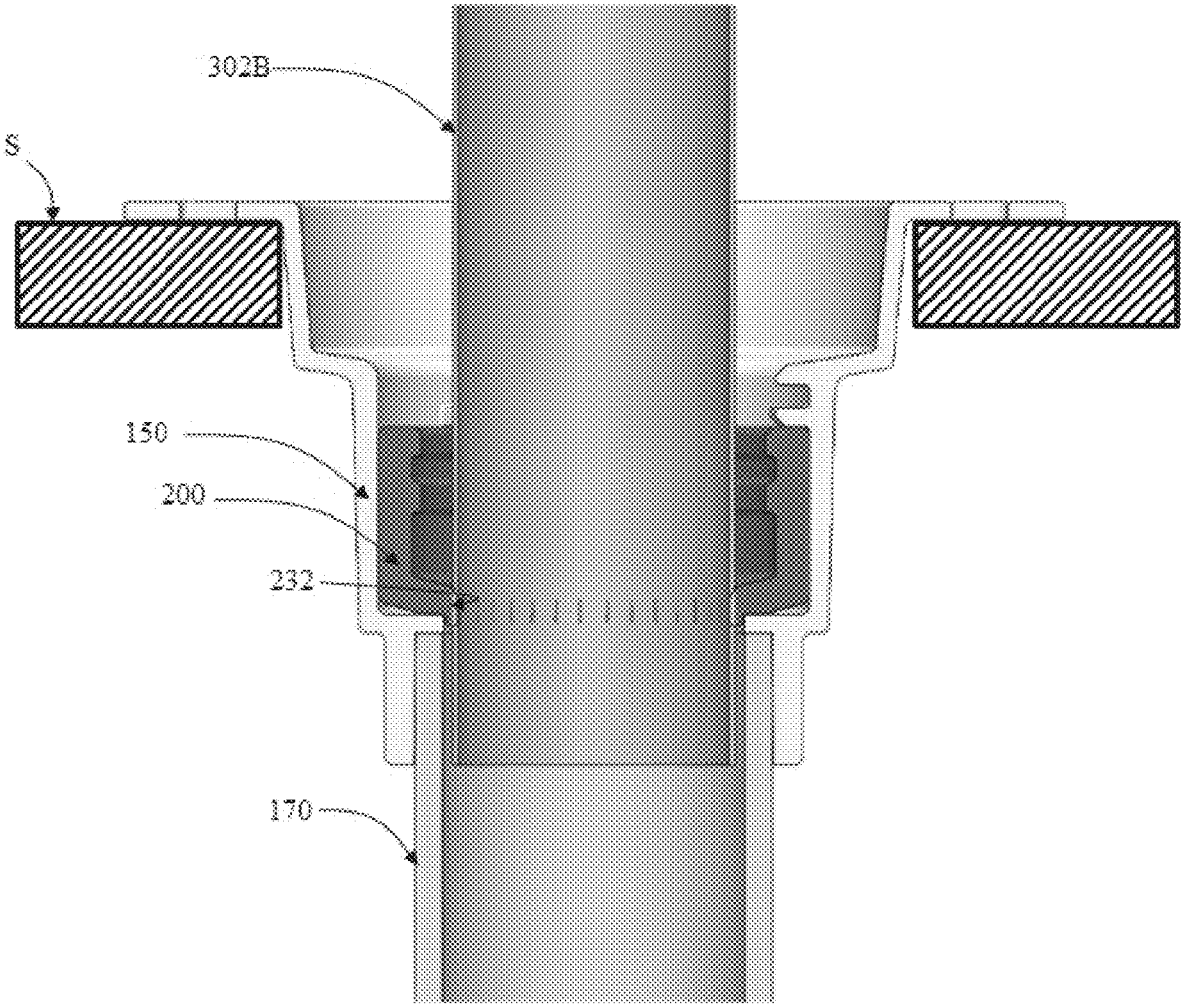
FIG. 7B is a cross-sectional view illustrating an installation of a drain assembly according to another aspect of this disclosure.

FIG. 7B illustrates a cross-sectional view of the drain body 140 with the gasket 200 positioned within the gasket chamber 154, and a second type of tailpipe 302B positioned within the gasket 200, according to an aspect of this disclosure. The second gasket portion 232 of the gasket 200 is sized such that the second gasket portion 232 engages an outer surface of the second type of tailpipe 302B. The second type of tailpipe 302B has a diameter that is less than a diameter of the first type of tailpipe 302A. The second type of tailpipe 302B can comprise metal tubing (e.g., brass or copper). For a given tubing inner diameter, the outer diameter of the plastic tubing is typically greater than the outer diameter of the metal tubing. In one aspect, the third gasket portion 234 of the gasket 200 proximate to the first end 204 can be sized to seal against the outer surface of a first type of tailpipe 302A (i.e., PVC and ABS plastic tubing). The second gasket portion of the gasket 200 proximate the second end 206 of the gasket 200 can be sized to seal against the outer surface of the second type of tailpipe 302B (i.e., brass and copper metal tubing).

The gasket 200 can create fluid seals between different sized tailpipes (e.g. the first and second type of tailpipes 302A and 302B) that are inserted into the drain body 140. Additionally, the size and configuration of the gasket 200 can allow the gasket 200 to create fluid seals between a tailpipe 302 that is out-of-alignment (e.g. angled relative to the drain axis D and/or horizontally offset from the drain axis D) with the drain body 140. For example, a portion of an end of the tailpipe 302 can engage the first gasket portion 230, and another portion of the end of the tailpipe 302 can engage the third gasket portion 234. The engagement of the end portions of the tailpipe 302 with the first and third gasket portions 230 and 234 can create a fluid seal between the gasket 200 and the out-of-alignment tailpipe 302. The size and shape of the internal ribs 218A, 218B, and 218C can also help maintain a seal between the gasket 200 and the tailpipe 302. For example, if there are three ribs 218A, 218B, and 218C, the center rib 218B can extend inwardly more than the upper and lower ribs 218A and 218C. In a situation with an out-of-alignment tailpipe 302, at least one of the internal ribs 218A, 218B, and 218C, or a combination of the internal ribs 218A, 218B, and 218C, can seal around the tailpipe 302.

Figure 5A:
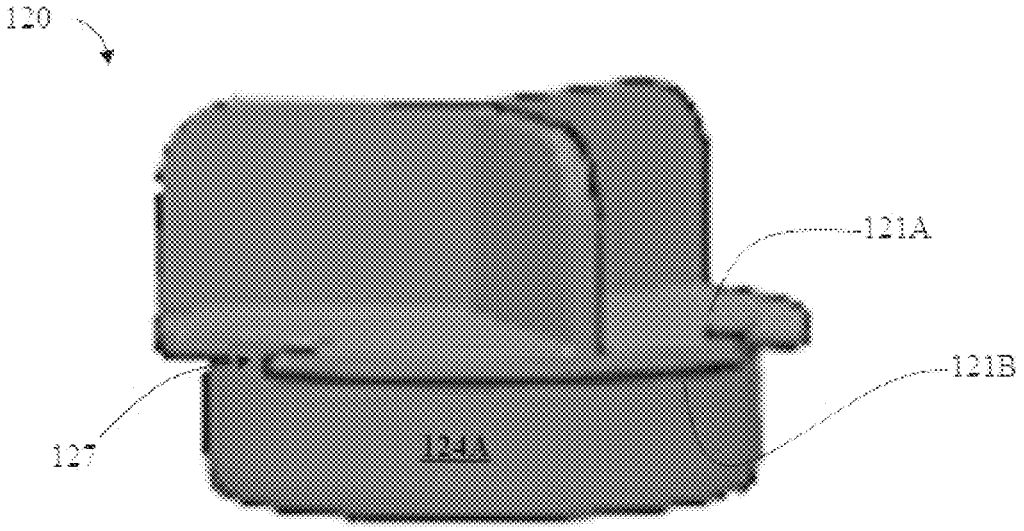
FIG. 5A is a perspective view of a removable test plug according to an embodiment.
Figure 5B:
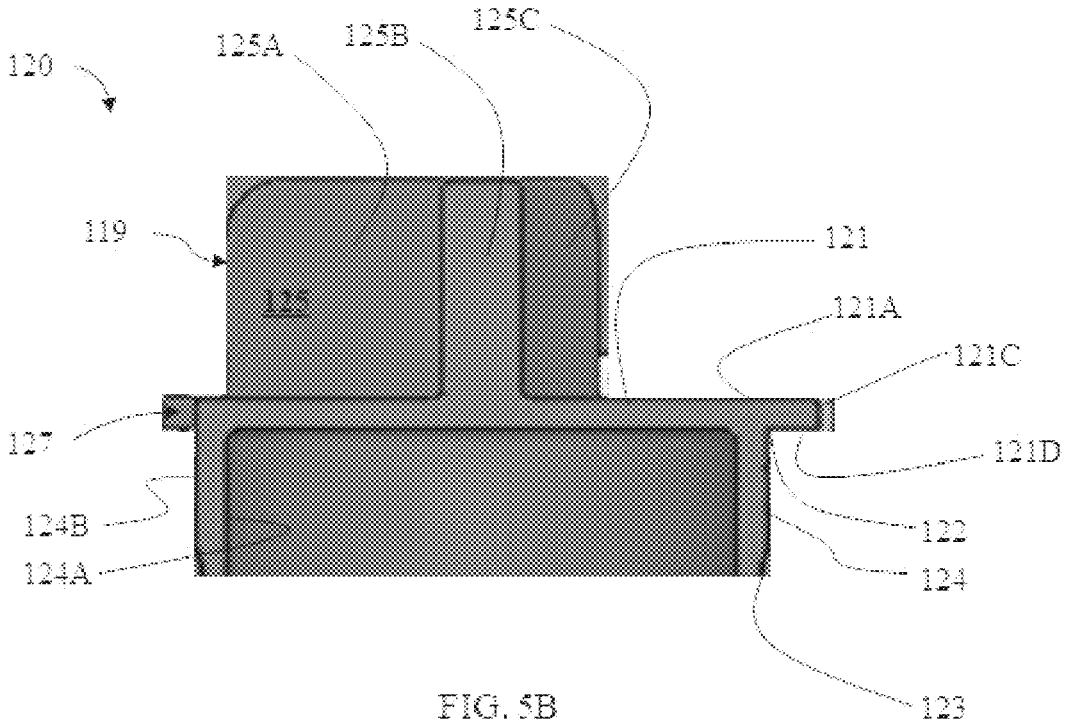
FIG. 5B is a cross-section view of the removable test plug illustrated in FIG. 5A.

FIG. 5A illustrates a top perspective view of the test plug 120, and FIG. 5B illustrates a side view of the test plug 120, according to aspects of this disclosure. The test plug 120 is configured to be inserted into and removably secured to the drain body 140. Plumbers (or other end users) can utilize test plugs 120 to perform pressure-related tests on the pipelines prior to completing installation. The test plug 120 is configured to attach quickly and easily to the drain body 140 and engage at least a portion of the gasket 200 disposed within the drain body 140. The engagement between the test plug 120 and the gasket 200 can create a fluid tight seal between the test plug 120 and the drain body 140.

The test plug 120 includes a plug body 119 that has a substantially disk shaped central portion 121 that has an upper surface 121A, a lower surface 121B, and an outer edge 121C. The outer edge 121C defines an outer diameter of the central portion 121 of the test plug 120. The plug body 119 also includes a substantially cylindrical portion that extends downwardly from the central portion lower surface 121B. The cylindrical portion includes a first end 122 proximate to the central portion lower surface 121B, a second end 123, and a test plug sidewall 124 that extends from the first end 122 to the second end 123. The test plug sidewall 124 includes a cylindrical test plug inner surface 124A that has an inner diameter of the test plug 120. The test plug sidewall 124 also includes a test plug outer cylindrical surface 124B that defines an outer diameter of the test plug 120. In an aspect, the outer diameter of the test plug sidewall 124 is less than the outer diameter of the central portion 121 of the test plug 120, thereby defining a test plug flange 121D that extends along the central portion from the test plug outer cylindrical surface to the outer edge 121C.

The plug flange 121D (e.g. plug locking projections of the test plug 120) defines the second locking feature that is configured to mate with the first locking feature 145 of the lower drain body 140. The plug flange 121D can include circumferential recesses or gaps 127 spaced about the central portion 121. The recesses 127 are configured to align with the upper projections 145A of the drain body 140 during insertion of the test plug 120 into the lower drain body 140 along the drain axis D such that the upper projections 145A pass through the recesses 127 when the test plug 120 is inserted into the gasket 200 to create a fluid tight seal. After the test plug 120 is inserted (e.g. first operative position), the test plug outer cylindrical surface 124B is configured to engage at least a portion of the gasket 200 to form the fluid seal between the plug 120 and gasket 200. After the test plug 120 is inserted, the test plug flange 121D can sit atop of the lower projections 145B. In an aspect, the test plug sidewall 124 may have a chamfer proximate to the second end 123 to aid in the insertion of the test plug 120 into the gasket 200.

After the test plug is inserted, the test plug 120 can be rotated about the drain axis D such that the recesses 127 are out of alignment with the upper projections 145A to substantially prevent the test plug 120 from being axially removed from the drain body 140 (e.g. second operative position). In an aspect, the rotation of the test plug 120 can include a quarter turn lock. The first locking feature 145 of the drain body 140 and the plug flange 121D of the test plug 120 are to prevent the test plug 120 from disengaging (or breaking the seal) during testing.

As described herein, in one aspect, the second sidewall 152 of the gasket body 162 includes the first locking feature 145 extending inwardly. The gasket chamber 154 is located between the first locking feature 145 and the third flange 153 of the drain body 140. The second locking feature (e.g. plug flange 121D) of the plug 120 engages with the first locking feature 145 to prevent axial movement of the test plug 120 within the drain body 140. Insertion of the test plug 120 into the gasket 200 prevents fluid flow through the drain body 140.

The test plug 120 includes a grip member 125 that is capable of being grasped by a user (or by a tool) in order to manipulate, rotate, translate, or otherwise affect the position of the test plug 120. As illustrated, the grip member 125 may comprise three tabs 125A, 125B, and 125C that extend upwardly from the upper surface 121A of the test plug central portion 121. When the test plug 120 is inserted into the drain body 140, the grip member 125 of the test plug 120 can be accessed through the first opening 148 of the drain body 140. One of skill in the art will appreciate that the handle may alternatively comprise any shape that will maintain a level of operability.

Figure 4A:
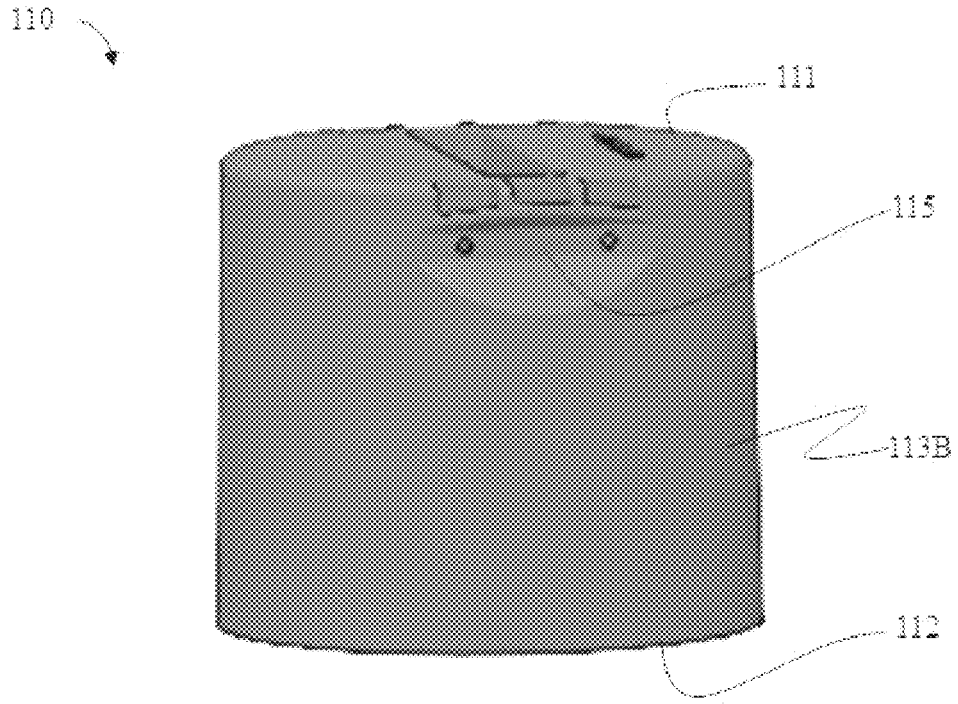
FIG. 4A is a perspective view of a protective cap covering according to an embodiment.
Figure 4B:
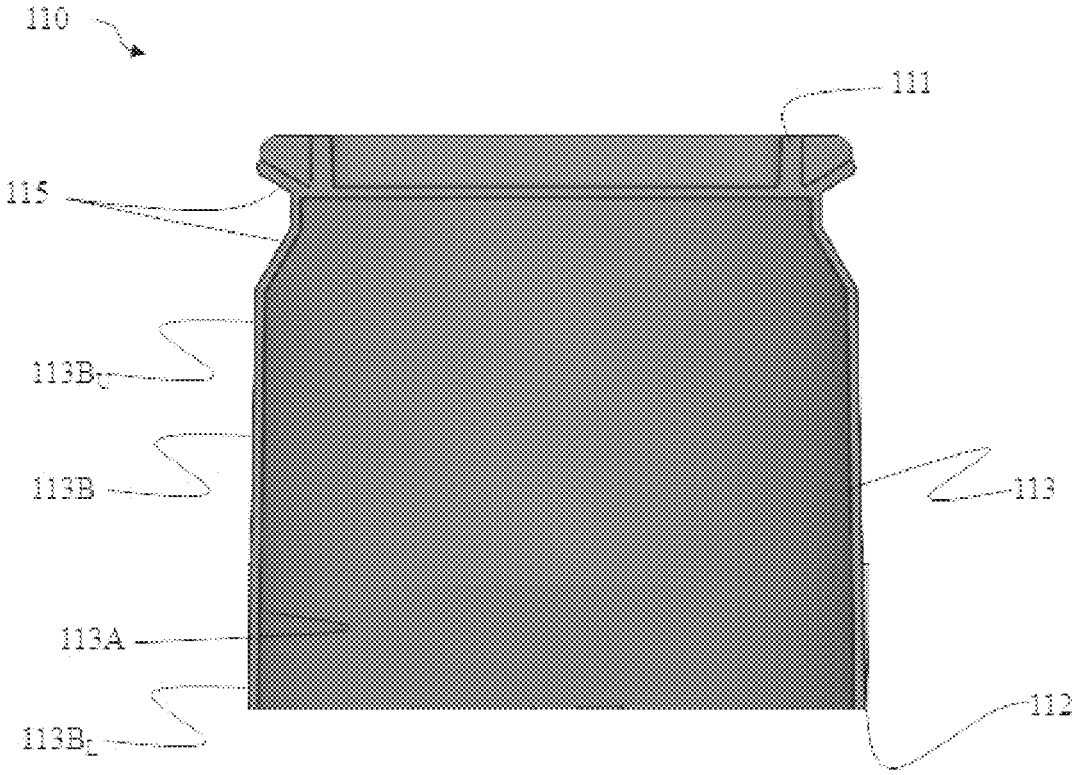
FIG. 4B is a cross-section view of the protective cap covering illustrated in FIG. 4A.

FIG. 4A illustrates a top perspective view of the protective cap covering 110, and FIG. 4B illustrates a cross-sectional view of the protective cap covering 110, according to aspects of this disclosure. The protective cap covering 110 is configured to be removably inserted into the drain body 140 to protect the drain assembly 100 during construction. The protective cap covering 110 includes a cap top end 111, a cap bottom end 112, and a cap sidewall 113 that extends from the cap top end 111 to the cap bottom end 112. The cap sidewall 113 has an inner cap surface 113A that defines a cap inner diameter. The cap sidewall 113 also defines an outer cap surface 113B that defines a cap outer diameter. In an aspect, the protective cap covering 110 has a frustoconical shape. As such, a cap outer diameter defined at a lower portion of the outer cap surface $113B_L$ is greater than a cap outer defined at an upper portion of the outer cap surface $113B_U$. It will be appreciated that that the protective cap covering 110 can include other shapes to facilitate protection of the drain assembly 100. The protective cap covering 110 may be configured such that a cap bottom end outer diameter (i.e., a diameter defined by the cap outer surface at the cap bottom end 112) fits within the recess 139 of the drain body 140 and abuts against the second flange 147. In an aspect, the cap bottom end outer diameter may be substantially similar to the inner diameter of the first sidewall 137 at the intersection of the second flange 147, thereby providing a tight fit when the protective cap covering 110 is inserted into the recess 139 of the drain body 140.

The removable protective cap covering 110 can be temporarily installed during construction, before the bathtub is installed, to prevent foreign debris from entering the drain assembly 100. The height of the cap extends from the second flange 147 to a height greater than a height of flooring to be positioned on top of a subfloor. In this way, the cap covering 110 can serve as an indicator to a flooring installer not to assemble flooring (e.g. tiling) above the drain assembly 100.

The protective cap covering 110 can further include one or more grasping features 115 to assist in the installation and removal of the the protective cap covering 110.

Figure 6A:
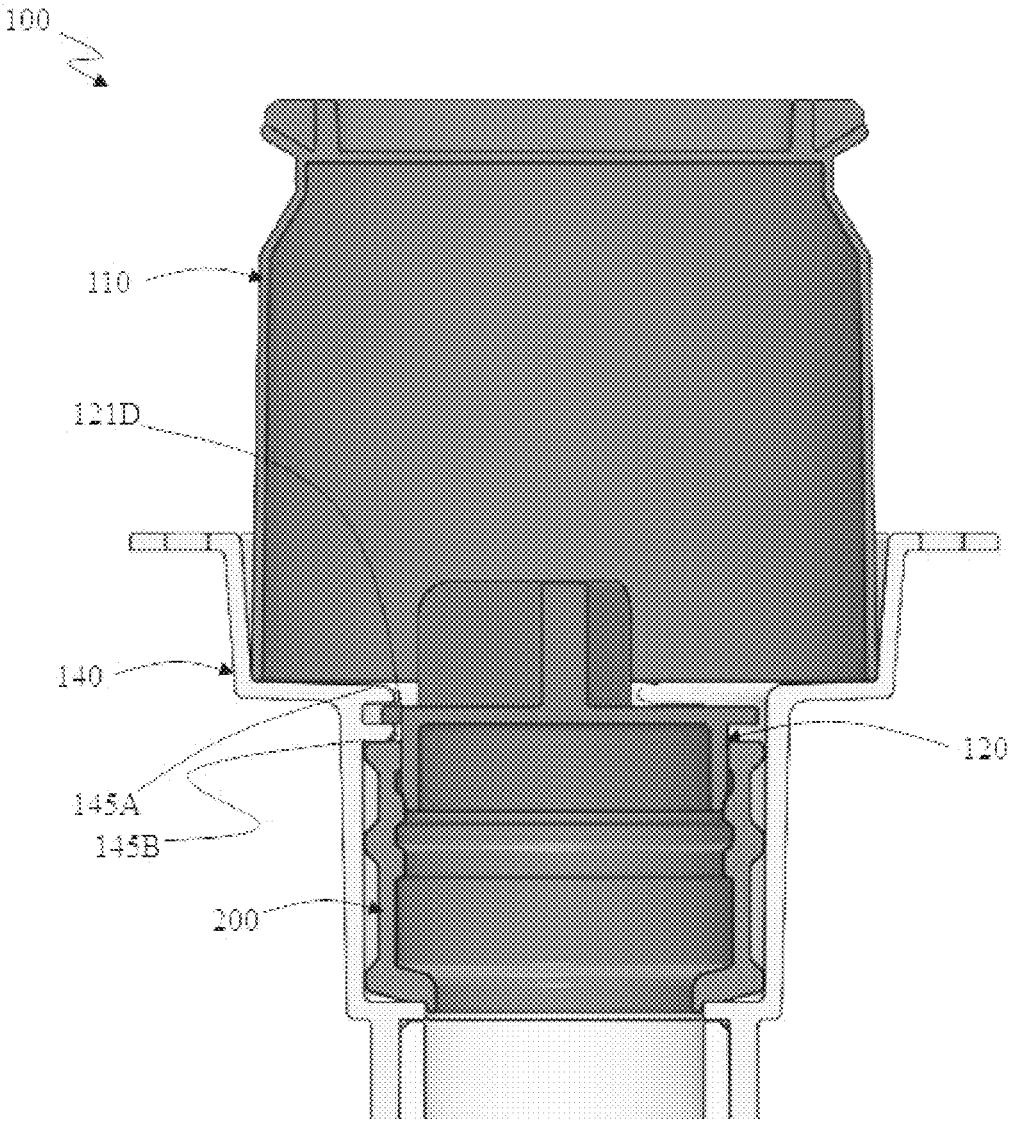
FIG. 6A is a cross-section of an assembly view of the drain assembly illustrated in FIG. 1.
Figure 6B:
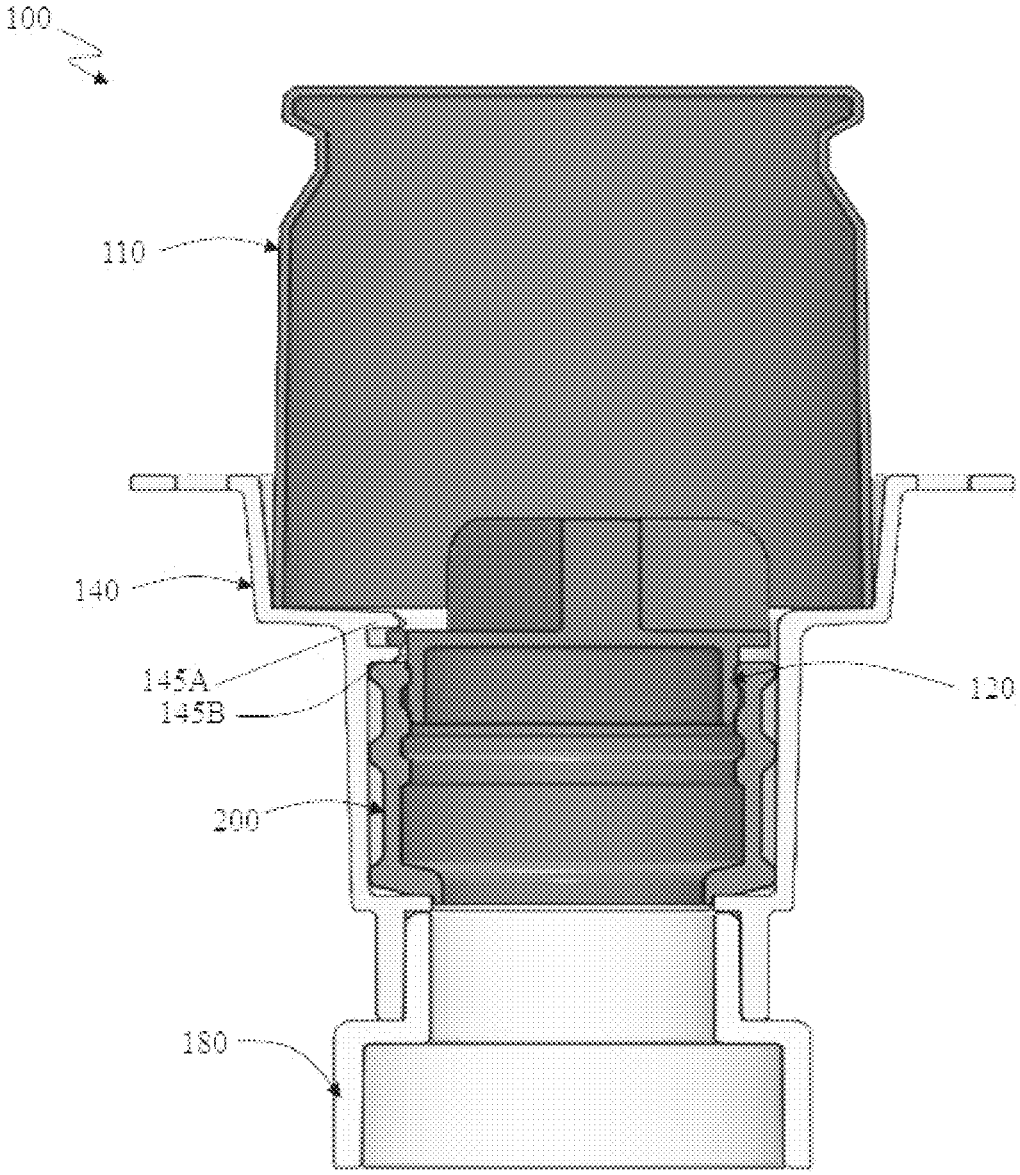
FIG. 6B is a cross-section of an assembly view of the drain assembly illustrated in FIG. 1A with an optional adapter.

FIGS. 6A and 6B illustrate cross-sections of an assembled view of the drain assembly 100 shown in FIG. 1. The protective cap covering 110 is installed within the recess 139 of the drain body 140. The gasket 200 is disposed within the gasket chamber 154 of the drain body 140. The removable test plug 120 is inserted into and secured to the drain body 140. The test plug flange 121D is mated with the first locking feature 145 between the upper and lower projections 145A and 145B. A portion of the test plug 120 is disposed within a portion of the gasket 200 proximate to the first end 204 of the gasket 200.

The adapter 180 is connected to the second end 143 of the drain body 140. The adapter 180 can attach the drain body 140 to drainpipes of various diameters. For example, different sized adapters 180 can be connected to the drain connector 164 depending on the size of the drainpipe below. The different sized adapters 180 can include different lengths to extend an overall length of the drain body 140, and can also include different diameters to accommodate drainpipes having various diameters.

The drain assembly 100 can be assembled by inserting the gasket 200 into the gasket chamber 154 of the drain body 140. The gasket 200 can flex to slide over and/or past the the upper and lower projections 145A and 145B until the second end 206 of the gasket 200 abuts against the third flange 153 of the drain body 140. If the drain body 140 includes retention projections 156, gasket 200 can further abut against the retention projections 156. When the gasket 200 is positioned within the gasket chamber 154, the first end 204 of the gasket 200 can be proximate the lower projections 145B of the drain body 140. When the first type of tailpipe 302A is inserted into the gasket 200, the first gasket portion 230 can be sandwiched between the end of the tailpipe 302A and retention projection 156. It will be appreciated that the the first gasket portion 230 can be sandwiched between the end of the tailpipe 302A and the third flange 153 of the drain body 140. When the second type of tailpipe 302B is inserted into the gasket 200, the second gasket portion 232 can be sandwiched between the outer surface of the tailpipe 302B and the retention projection 156. In an aspect, at least a portion of the second gasket portion 232 can extend at least partially through the third opening 165 in the drain body 140. The lower projections 145B, the third flange 153, and the retention projections 156 can removably secure the gasket 200 within the gasket chamber 154.

Referring again to FIGS. 7A and 7B, after the drain assembly 100 is assembled, the drain assembly 100 can be fastened to the subfloor S. The drain body 140 can extend through a hole in the subfloor S, and the flange 144 can be positioned above the subfloor S. Fasteners can be inserted through the holes 149 to secure the drain assembly 100 to the subfloor S. Mortar or thinset can be applied over the flange of the drain assembly 100 and into the openings 146 of the flange 144.

For running a pressurized leak test, the test plug 120 can be installed above the gasket 200. The test plug 120 can be inserted through the recess 139 of the drain body 140 until the test plug flange 121D moves below the upper projections 145A and abuts the lower projections 145B in the drain body 140. The recesses defined by the test plug 120 can axially align with the upper projections 145A of the first locking feature 145 within the drain body 140 so that the plug flange 121D can move past the upper projections 145A along the drain axis D until the plug flange 121D abuts against the lower projections 145B of the first locking feature 145. After the test plug 120 is inserted, the test plug 120 can be rotated so that the test plug flange 121D is positioned directly below at least one of the upper projections 145A. In this position, the upper and lower projections 145A and 145B removably retain the test plug 120 within the drain assembly 100. Once the test plug 120 is secured within the drain body 140, the pressurized leak test can be performed.

To remove the test plug 120 from the drain assembly 100, the test plug 120 can be rotated until the recesses 127 of the test plug flange 121D vertically align with corresponding upper projections 145A. Once aligned, the test plug 120 can be removed by vertically lifting the test plug 120 out of the drain assembly 100 along the drain axis D.

To install a tub into the drain assembly 100, the tub tailpipe 302 of the tub is inserted into the gasket 200 positioned within the gasket chamber 154. A tailpipe 202 with a larger diameter (e.g. tailpipe 302A) can abut against the first gasket portion 230 of the gasket 200 to create a fluid seal therebetween. Additionally, an outer surface of the tailpipe 302A can engage the third gasket portion 234 to further improve the fluid seal between the gasket 200 and the tailpipe 302A. A tailpipe 202 with a smaller diameter (e.g. tailpipe 302B) can extend through the gasket 200 and out of the second opening 214 at the second end 206 of the gasket 200. The second gasket portion 232 can engage and contact the outer surface of the tailpipe 202A to substantially prevent leakage through the drain assembly 100.

As described above, the drain assembly 100 is configured to receive a tub tailpipe 202 that can have various diameters. For example, the tailpipe 302A can include, for example, a 1.5" Schedule (SCH) 40 tube. The tailpipe 302B can include, for example, a 1.5" brass tube.

FIGS. 8 through 16 illustrate another aspect of a drain assembly 300. Portions of the aspect disclosed in FIGS. 8 through 16 are similar to aspects described above in FIGS. 1 through 7B and those portions function similarly to those described above. The drain assembly 300 includes a removable protective cap 310, a test plug 320, a gasket 330, a drain portion 340, a gasket body 350, and a drain connector 360. The drain assembly 300 can also include connecting screws 362, screw holders 364 (e.g. inserts), and one or more o-rings 380. The drain assembly 300 may be positioned and installed on a subfloor and connected to a drainpipe in a substantially similar manner as drain assembly 100.

Referring to FIGS. 9 through 13, in an aspect, the drain portion 340 can be a separate part that is connectable to the gasket body 350 and the drain connector 360. In another aspect, the gasket body 350 and the drain connector 360 can be integrally formed together. The drain portion 340 can be connected to the lower drain body by the connecting screws 362. In an aspect, a bottom portion 343 of the drain portion 340 can define screw holes 344 therethrough. The gasket body 350 can include receiving screw holes 346 that correspond to the screw holes 343 defined by the drain portion 340. The drain portion 340 can be connected to the gasket body 350 by placing the drain portion 340 onto an upper surface of the gasket body 350 and inserting the connecting screws 363 through the screw holes 344 and into the receiving screw holes 346. In an aspect, the bottom portion 343 can include a bottom surface that lies substantially flush against a corresponding upper surface of the gasket body 350. In an aspect, screw holders 364 can be inserted into the receiving screw holes 346 to increase the connection strength between the connecting screws 362 and the receiving screw holes 346. The screw holders 364 can be pre-assembled into the gasket body 350. The screw holders 364 can comprise, for example, a brass material. In an aspect, the gasket body 350 and the drain connector 360 can be formed as an integrated unitary single part with the screw holders 364 assembled into the gasket body 350.

The drain portion 340 includes a first locking feature 345 that comprises at least one upper projection 345A and at least one lower projection 345B. The at least one lower projection 345B can be substantially flush with a recess bottom surface 343A. The upper projections 345A can extend upward from an edge of the bottom surface 343A into a recess 339 of the drain portion 340. The first locking feature 345 is configured to engage and removably lock the test plug 320 to the drain portion 340.

In an aspect, the gasket body 350 and drain connector 360 comprise PVC, ABS, or other non-metal piping material. The drain portion 340 can comprise steel or other metal material commonly used to manufacture drain bodies.

The o-ring 380 can be connected to the drain assembly 300 between the drain portion 340 and the gasket body 350 to prevent leakage between the two. In an aspect, the o-ring extends about a perimeter of the drain assembly 300 between the drain portion 340 and gasket body 350. It will be appreciated that other sealing materials and/or components can be included in the drain assembly 300 to prevent leakage. For example, a sealant can be added between the contacting surfaces of the drain portion 340 and gasket body 350.

Figure 13:
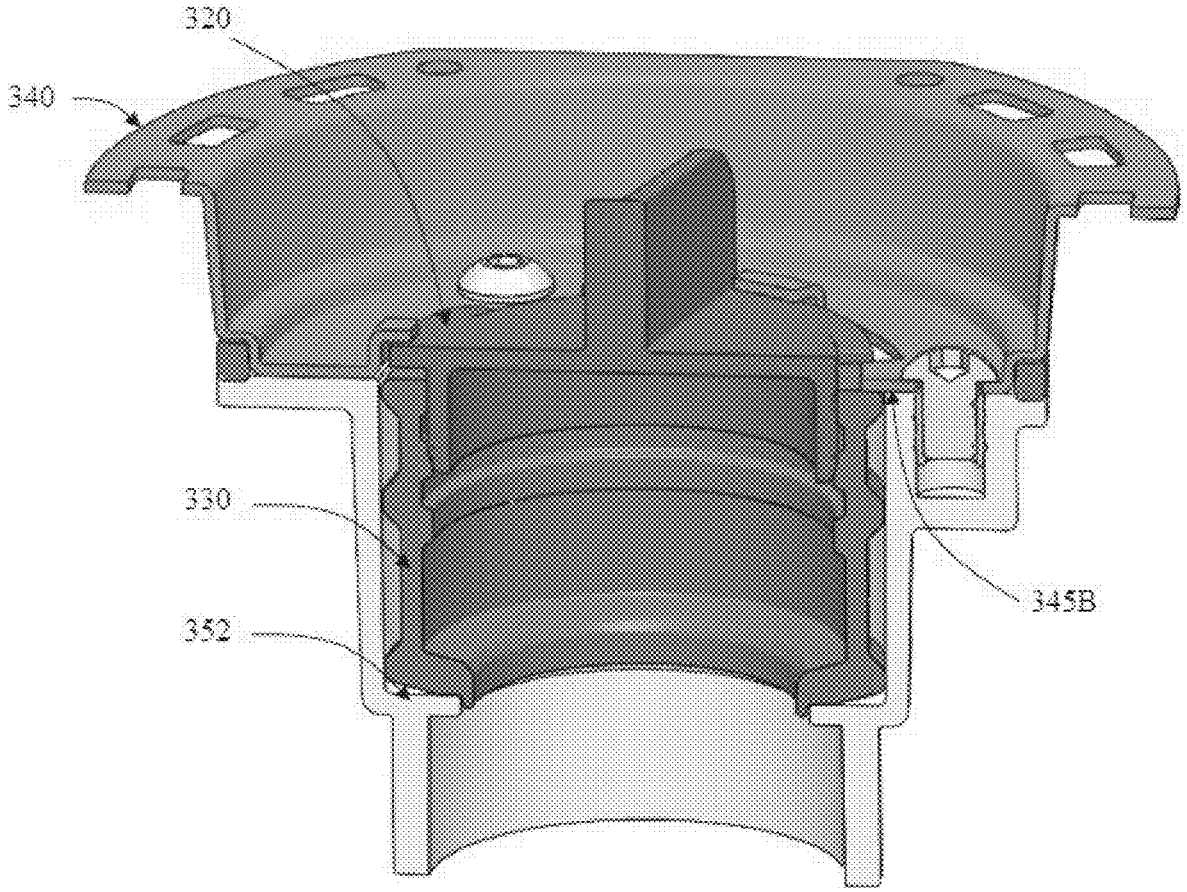
FIG. 13 is a top perspective view of a cross section of the upper drain body illustrated in FIG. 9 connected to the lower drain body and the hub illustrated in FIG. 10 and a gasket and a test plug positioned within.

With reference to FIG. 13, the gasket 130 can be disposed within the gasket body 350. In an aspect, the gasket 130 is secured within the gasket body 350 between the lower projections 145B of the drain portion 340 and a lower drain body bottom end 352 when the upper drain body 140 is connected to the gasket body 350.

Figure 8:
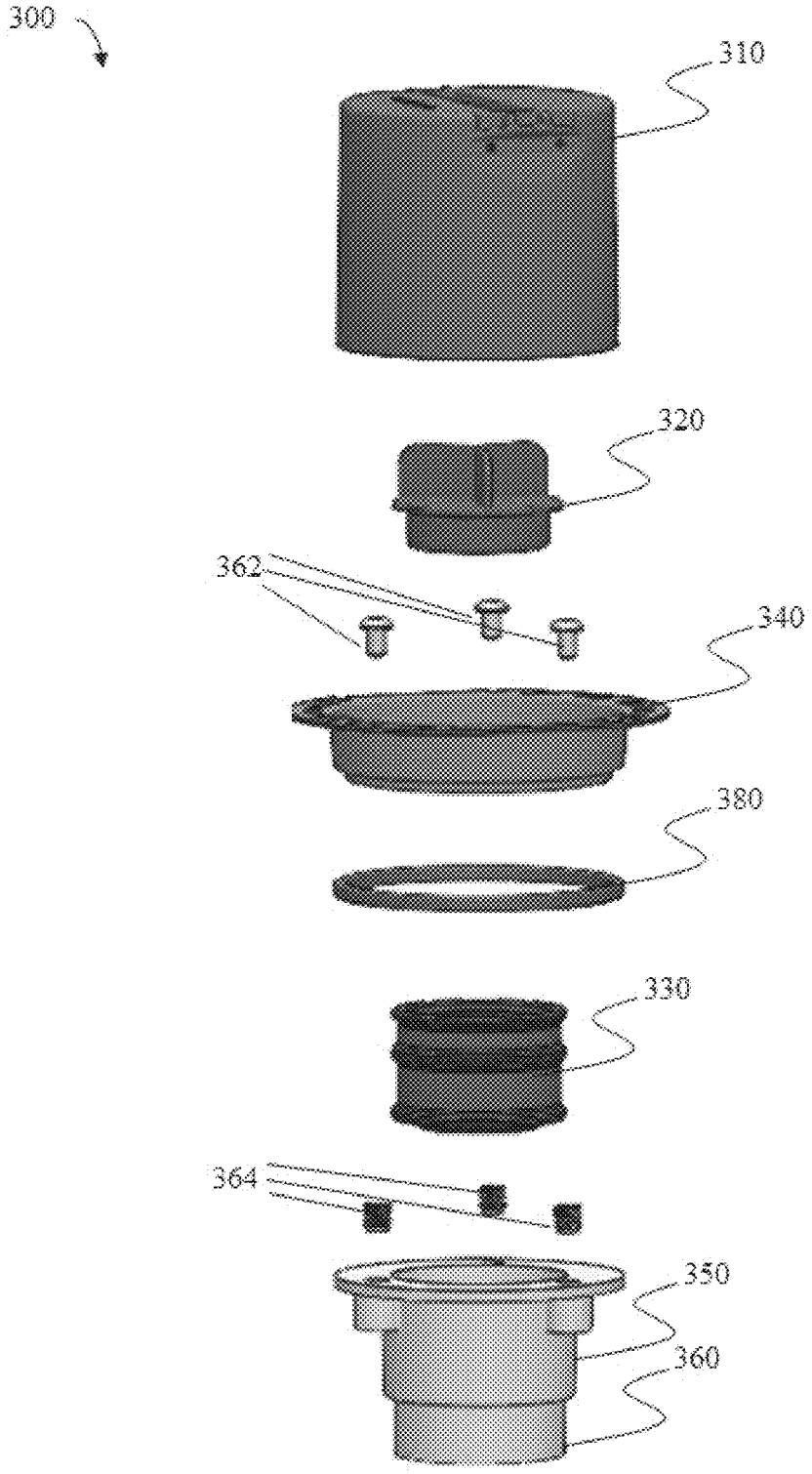
FIG. 8 is an exploded view of a drain assembly, according to another aspect of this disclosure.
Figure 9:
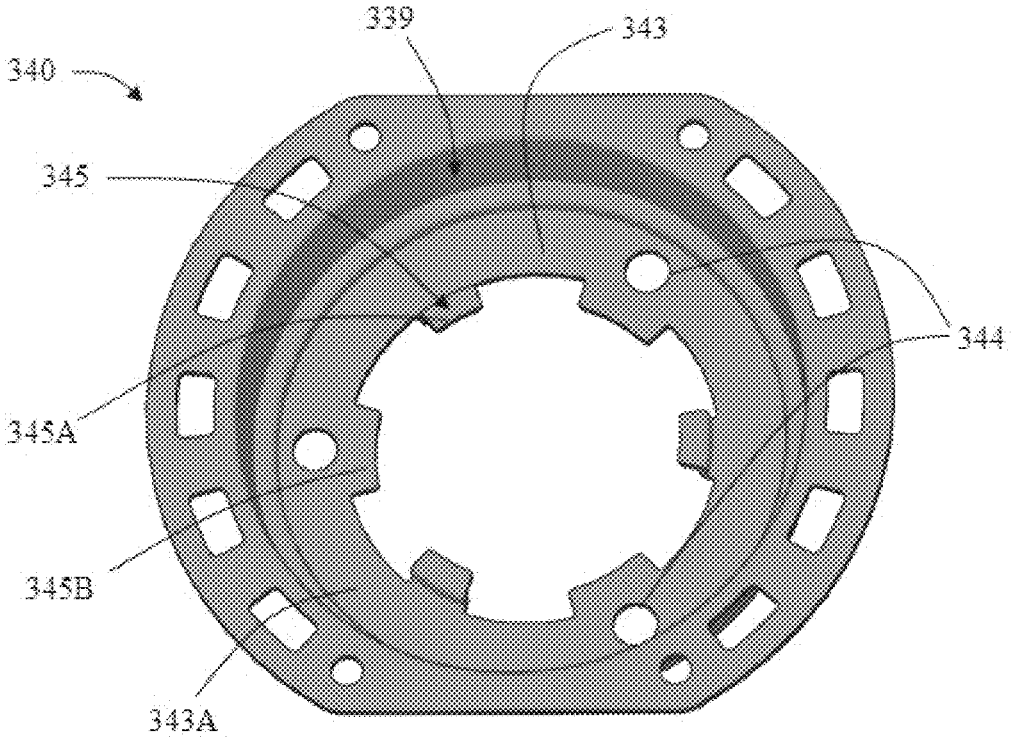
FIG. 9 is a top perspective view of an upper drain body of the drain assembly illustrated in FIG. 8.
Figure 10:
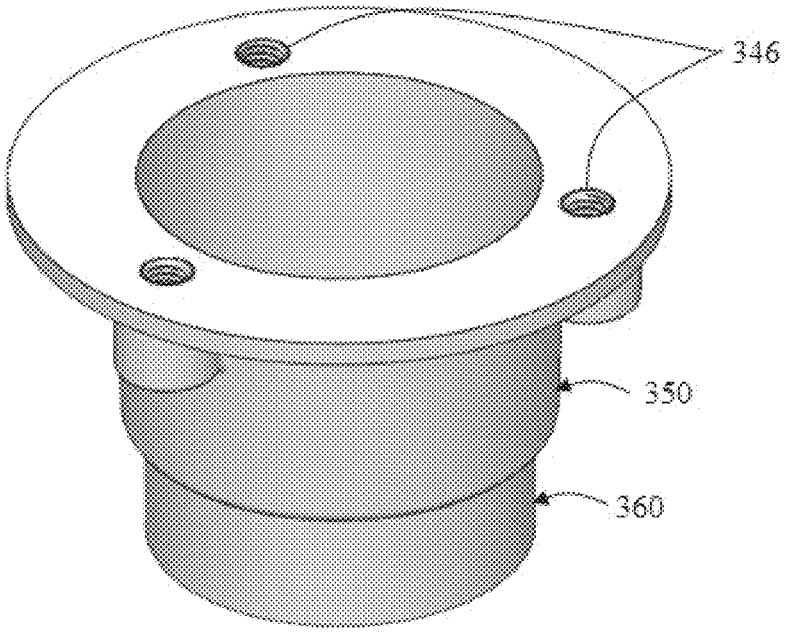
FIG. 10 is a top perspective view of a lower drain body and a hub of the drain assembly illustrated in FIG. 8.
Figure 11:
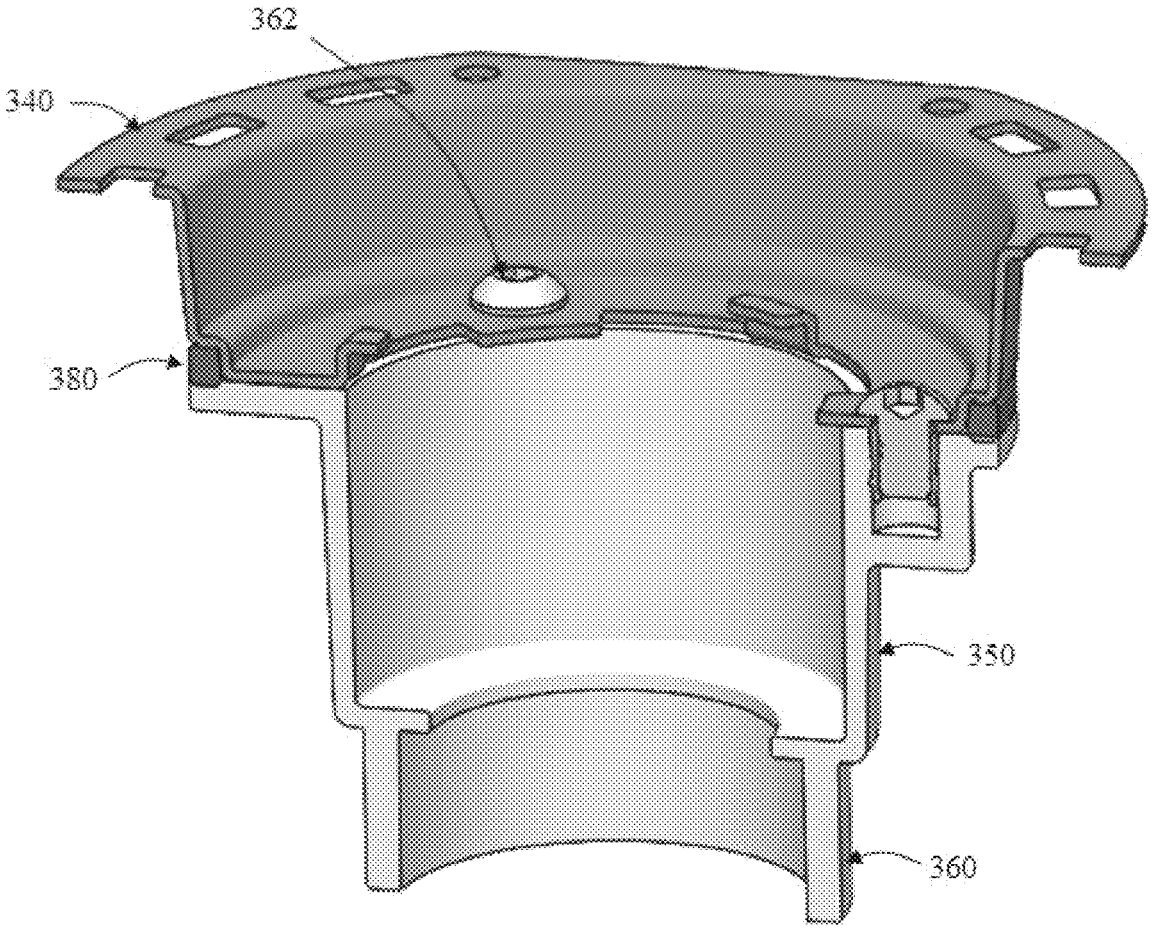
FIG. 11 is a top perspective view of a cross-section of the upper drain body illustrated in FIG. 9 connected to the lower drain body and the hub illustrated in FIG. 10.
Figure 12A:
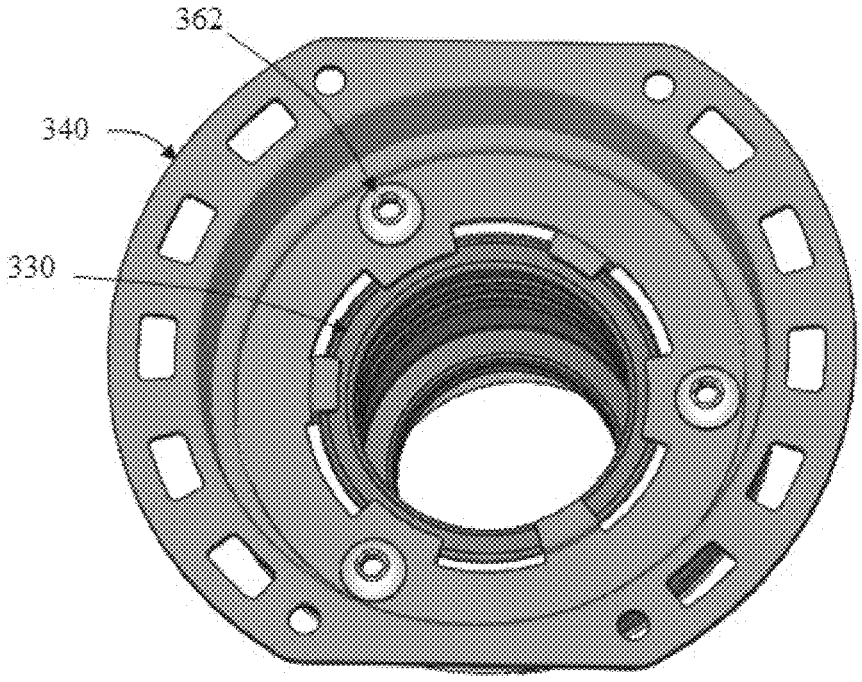
FIG. 12A is a top perspective view of the upper drain body illustrated in FIG. 9 connected to the lower drain body and the hub illustrated in FIG. 10 and a gasket positioned within.
Figure 12B:
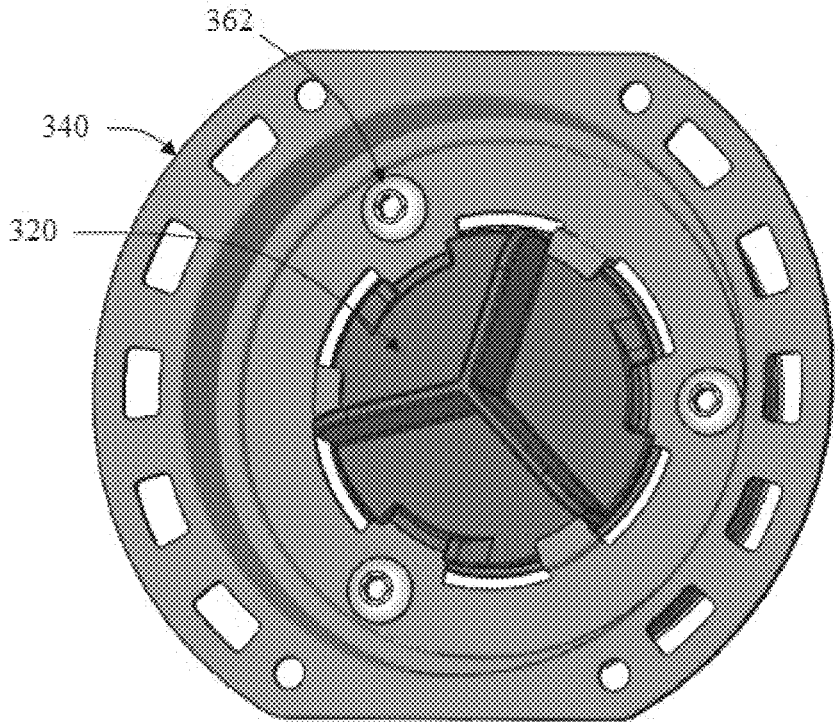
FIG. 12B is a top perspective view of the upper drain body illustrated in FIG. 9 connected to the lower drain body and the hub illustrated in FIG. 10 and a test plug positioned within.
Figure 14A:
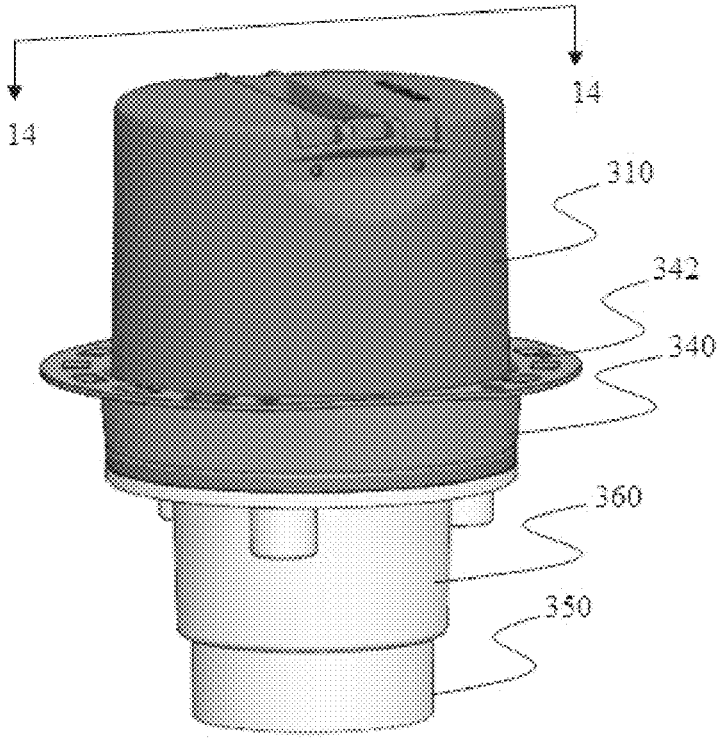
FIG. 14A is an assembled view of the drain assembly illustrated in FIG. 8.
Figure 14B:
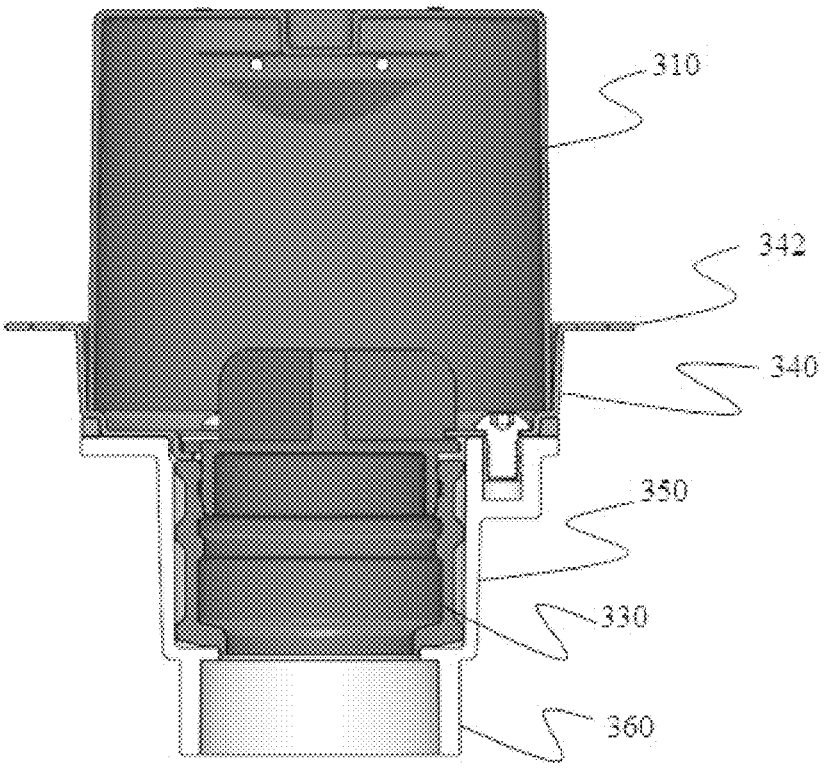
FIG. 14B is an assembled view of a cross-section of the drain assembly illustrated in FIG. 8.

FIG. 14A is an assembly view of the drain assembly 300 illustrated in FIG. 8. The protective cap covering 310 is installed within the recess 339 of the drain portion 340. The gasket 330 is disposed within the gasket body 350. The removable test plug 320 is inserted in the bottom portion 343 of the drain portion 340 and disposed within a portion of the gasket 330. The drain portion 340 is connected to the gasket body 350.

Figure 15:
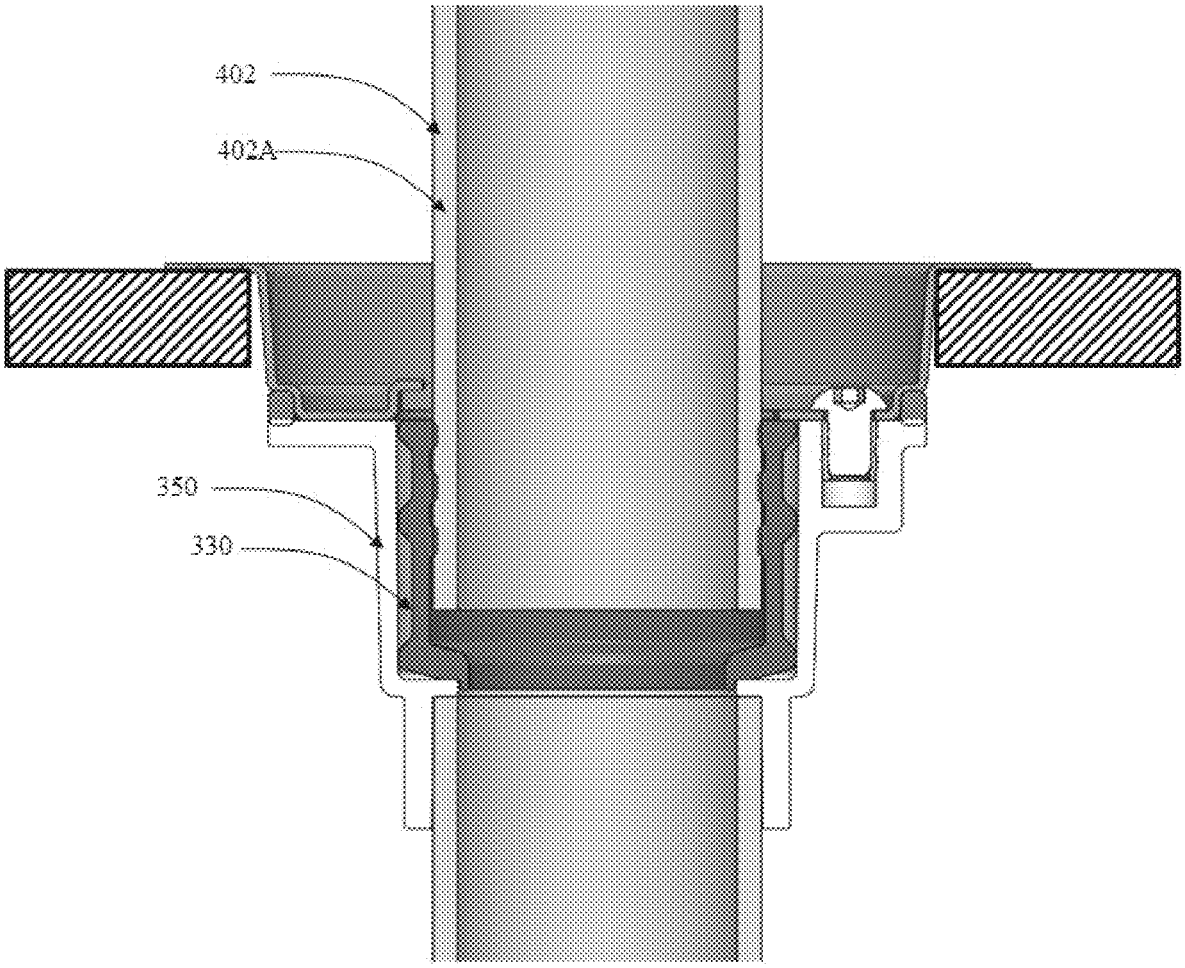
FIG. 15 is a cross-sectional view illustrating an installation of the drain assembly illustrated in FIG. 8, according to an aspect of this disclosure.
Figure 16:
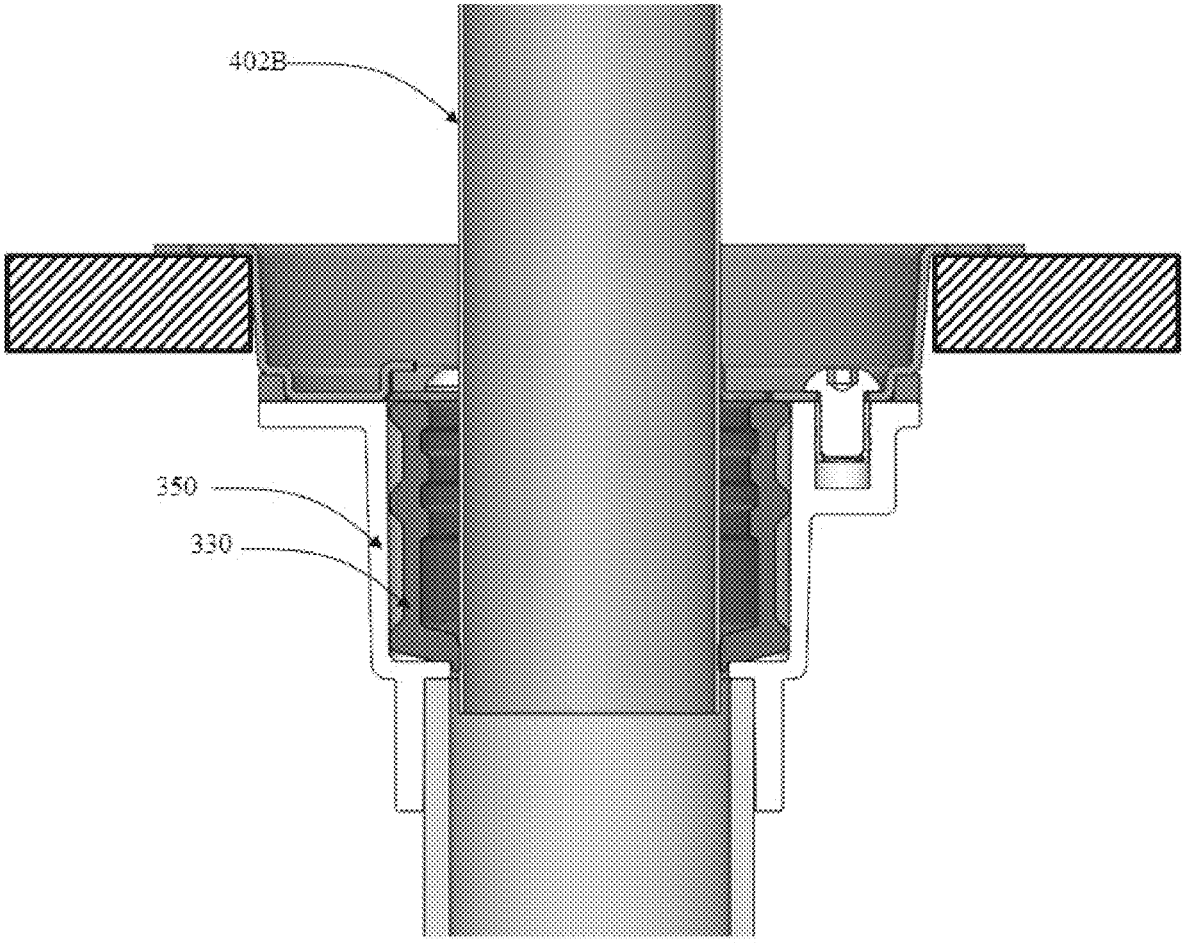
FIG. 16 is a cross-sectional view illustrating an installation of the drain assembly illustrated in FIG. 8, according to another aspect of this disclosure.

With reference to FIGS. 15 and 16, the gasket 330 is configured to receive at least a portion of a tailpipe 402 within. The gasket 330 can be configured such that a first portion of the gasket 330 engages the outer surface of a first type of tailpipe 402A. The gasket 330 can be further configured to also receive the second type of tailpipe 402B, wherein outer diameters of the first and second tailpipes 402A and 402B are different. The gasket 330 is configured to receive and contact an outer surface of tailpipes that have different outer diameters.

Figure 17:
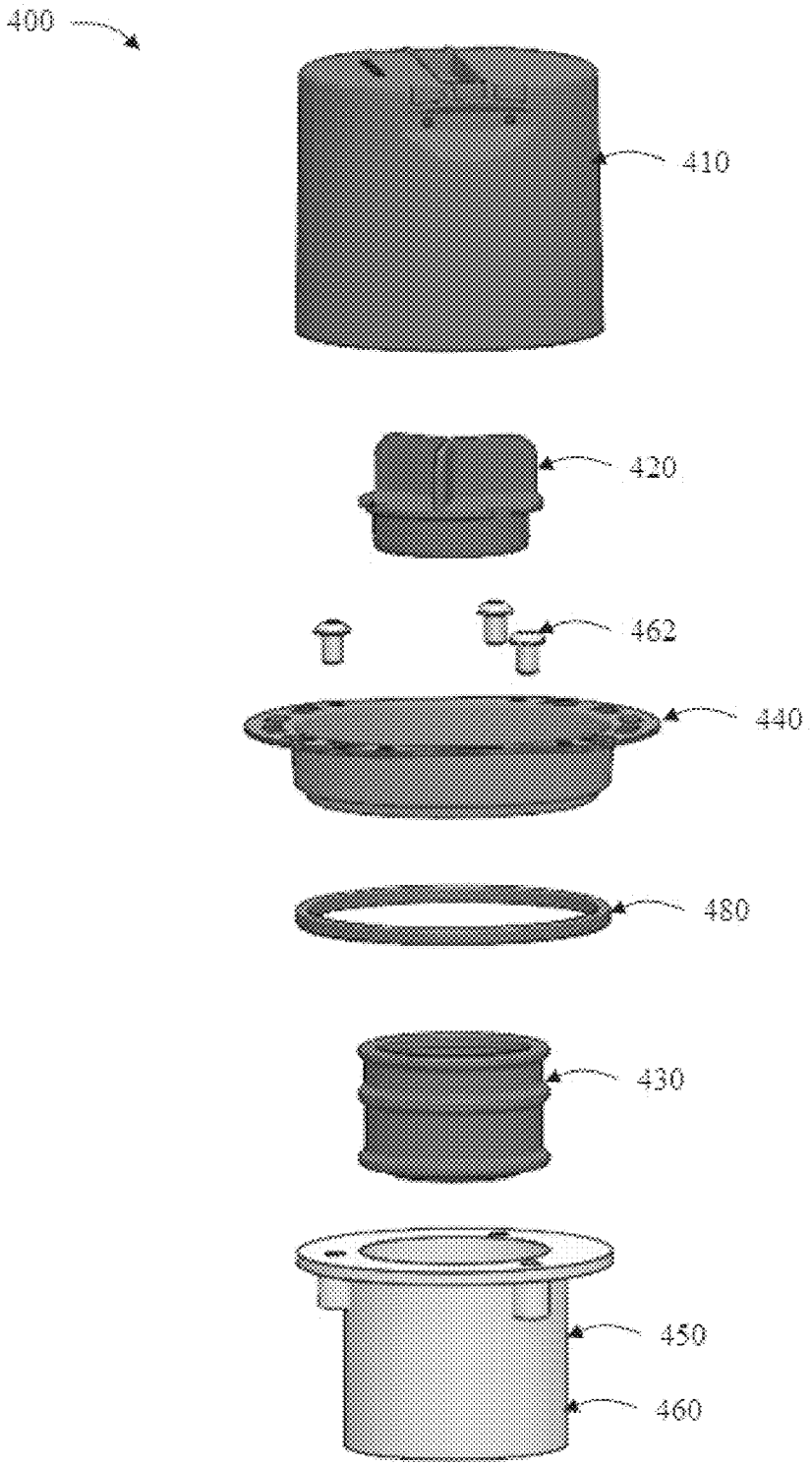
FIG. 17 is an exploded view of a drain assembly, according to another aspect of this disclosure.
Figure 18:
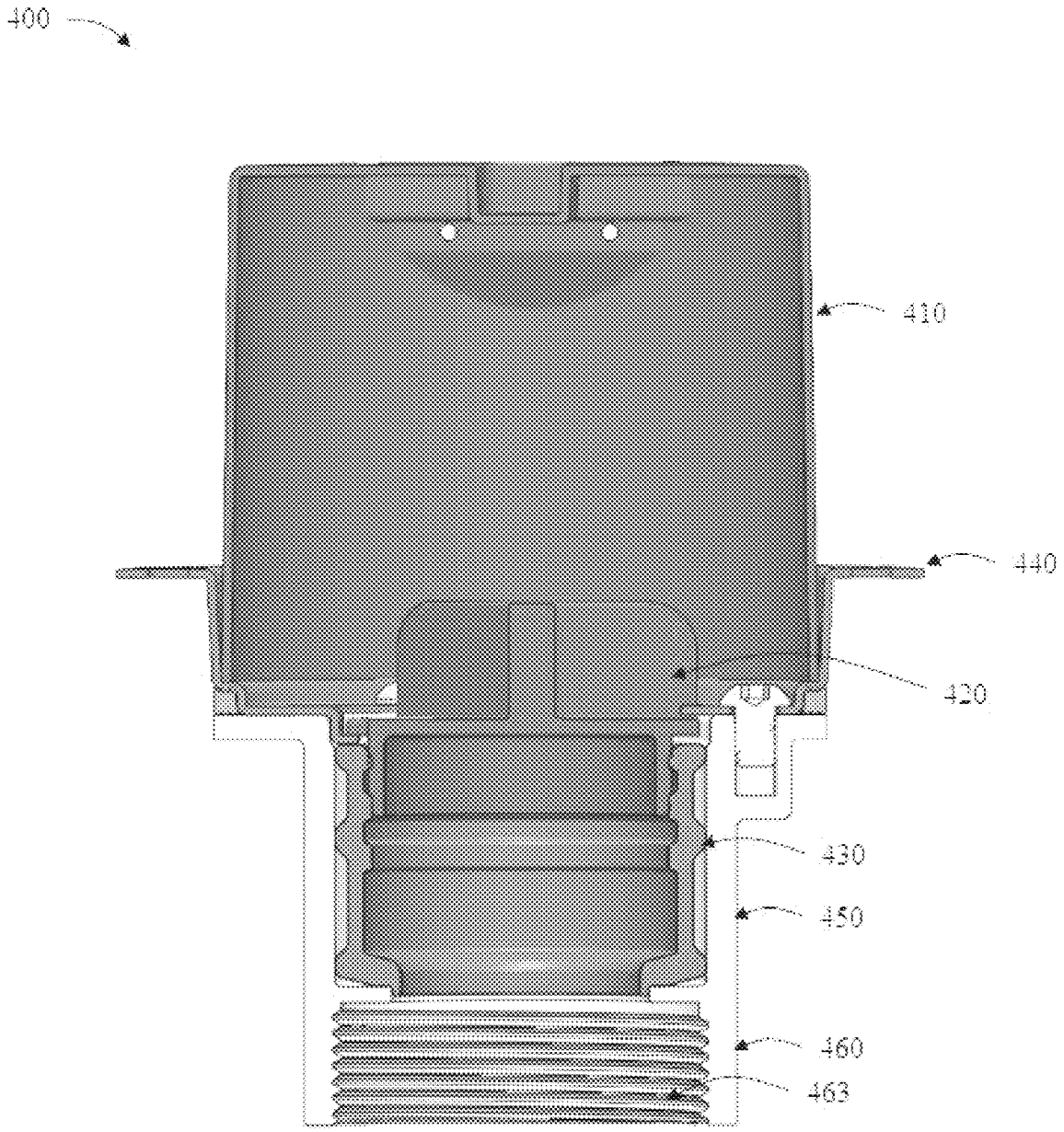
FIG. 18 is an assembled view of a cross-section of the drain assembly illustrated in FIG. 17.

FIGS. 17 and 18 illustrate another aspect of a drain assembly 400. Portions of the aspect disclosed in FIGS. 17 and 18 are similar to aspects of drain assembly 100 and drain assembly 300 described above in FIGS. 1 through 7B and FIGS. 8-16, respectively, and those portions function similarly to those described above. The drain assembly 400 includes a removable protective cap 410, a test plug 420, a gasket 430, a drain portion 440, a gasket body 450, and a drain connector 460. The drain assembly 400 can also include connecting screws 462 and one or more o-rings 480. The drain assembly 400 may be positioned and installed on a subfloor and connected to a drain pipe in a substantially similar manner as drain assemblies 100 and 300.

The drain portion 440 can be a separate part that is connectable to the gasket body 450. The drain portion 440 can be connected to the lower drain body by the connecting screws 462. The connecting screws 462 can be inserted through a flange of the drain portion 440 and into corresponding holes defined by the gasket body 450.

In an aspect, the gasket body 450 and hub 460 comprise a single integrated unitary piece. The gasket body 450 and the drain connector 460 can comprise cast iron. The drain portion 340 can comprise steel or other metal material commonly used to manufacture drain bodies. The drain connector 460 can define internal threads 463 configured to threadedly engage a drainpipe positioned below the drain connector 460 during installation.

As described herein, in an aspect, a drain assembly to connect an island tub to a drainpipe comprises a drain body, a gasket, and a removable test plug. The drain body includes a body sidewall, a plurality of upper locking projections, and a plurality of lower locking projections. The body sidewall extends from a top end to a bottom end, and has an inner body surface that defines a drainage channel that extends from the top end to the bottom end. The plurality of upper locking projections extend radially inward from the body sidewall. The plurality of lower locking projections extend radially inward from the body sidewall. The lower locking projections are spaced from the plurality of upper locking projections toward the bottom end of the body sidewall. The drain body defining a gasket chamber between the lower locking projections and the bottom end of the body sidewall. The gasket is positioned within the gasket chamber and located immediately adjacent to the plurality of lower locking projections. The gasket has a first opening adjacent to the plurality of lower locking projections and an opposing second opening positioned adjacent to the bottom end of the body sidewall of the drain body. The removable test plug includes a plug body, a grip member, and a plurality of plug locking projections. The grip member extends axially from an upper end of the plug body. The plurality of plug locking projections extend radially outward from the plug body. The plug body of the test plug is insertable into the first opening of the gasket to prevent fluid flow through the drainage channel and is rotatable between a first operative position and a second operative position. In the first operative position, the upper and lower locking projections of the drain body are positioned between adjacent plug locking projections of the test plug. In the second operative position the upper and lower locking projections of the drain body are positioned adjacent to opposing surfaces of each plug locking projection such that axial movement of the test plug within the drainage channel is substantially prevented. In a further aspect, gaps between adjacent projections on the test plug where the locking projections of the drain body pass through the gaps when the test plug is inserted into the gasket create a seal.

As described herein, in an aspect, a drain assembly to connect an island tub to a drainpipe comprises a drain body, a gasket, and a removable test plug. The drain body includes a body sidewall, a plurality of upper locking projections, and a plurality of lower locking projections. The body sidewall extends from a top end to a bottom end, and has an inner body surface that defines a drainage channel that extends from the top end to the bottom end. The body sidewall having a first locking mechanism extending radially inward. The drain body defining a gasket chamber between the first locking mechanism and the bottom end of the body sidewall. The gasket is positioned within the gasket chamber. The gasket has a first opening adjacent to the first locking mechanism and an opposing second opening positioned adjacent to the bottom end of the body sidewall of the drain body. The removable test plug includes a plug body, a grip member, and a second locking mechanism. The grip member extends axially from an upper end of the plug body. The second locking mechanism is engageable with the first locking mechanism to prevent axial movement of the test plug relative to the drain body. The plug body of the test plug is insertable into the first opening of the gasket and is rotatable between a first operative position and a second operative position. In the first operative position, a seal is formed between the test plug and the gasket to prevent fluid flow through the drainage channel. In the second operative position, the test plug is locked to the drain body such that axial movement of the test plug within the drainage channel is substantially prevented.

As described herein, in an aspect, a drain assembly to connect an island tub to a drainpipe comprises a drain body and a gasket. The drain body includes a drain portion, a gasket body, and a drain connector. The drain body has an upper end that defines an upper drain opening and a lower end that defines a lower drain opening. The lower end is spaced from the upper end along a drain axis. The drain body includes a locking mechanism extending radially inward. The drain body defines a drainage channel between the upper and lower drain openings. The drain connector extends from the gasket body. The gasket body and the drain connector are integrally formed together. The drain body is separate from and connectable to the gasket body. The gasket is positioned within the gasket chamber of the drain body.

It will be appreciated that the foregoing description provides examples of the disclosed system and method. However, it is contemplated that other implementations of the disclosure may differ in detail from the foregoing examples. For example, any of the embodiments disclosed herein can incorporate features disclosed with respect to any of the other embodiments disclosed herein. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

As one of ordinary skill in the art will readily appreciate from that processes, machines, manufacture, composition of matter, means, methods, or steps, presently existing or later to be developed that perform substantially the same function or achieve substantially the same result as the corresponding embodiments described herein may be utilized according to the present disclosure.

What is claimed:

1. A drain assembly for connecting an island tub to a drainpipe, the island tub having a first tailpipe with a first outer diameter or a second tailpipe with a second outer diameter that is less than the first outer diameter, the assembly comprising:

a drain body being attachable to and fluidly connectable with the drainpipe, the drain body includes a body sidewall extending from a first end to a second end, the body sidewall having an inner body surface that defines a gasket chamber within the drain body, the drain body further comprising a projection that extends radially inward from the body sidewall, the projection defining a bottom end of the gasket chamber, wherein the bottom end includes an opening formed therethrough; and a gasket disposed at least partially within the gasket chamber, the gasket having a first sealing portion being engageable with a terminal end of the first tailpipe to create a fluid seal therebetween, wherein the first sealing portion directly overlies the projection of the drain body such that the first sealing portion, the terminal end of the first tailpipe, and the projection share a common vertically-oriented axis, and the gasket also having a second sealing portion being engageable with an outer surface of the second tailpipe to create a fluid seal therebetween, wherein the second sealing portion extends at least partially through the opening at the bottom end of the gasket chamber.

2. The drain assembly of claim 1, wherein the first tailpipe is plastic and the second tailpipe is metal.

3. The drain assembly of claim 1, wherein the first sealing portion includes a sealing surface and the second sealing portion includes an inner sealing edge, the inner sealing edge defines a gasket opening, and the sealing surface extends radially outward from the inner sealing edge, wherein the sealing surface is engageable with the end of the first tailpipe, and wherein the inner sealing edge is engageable with the outer surface of the second tailpipe.

4. The drain assembly of claim 3, wherein the gasket opening is sized to receive the second tailpipe such that a terminal end of the second tailpipe passes therethrough.

5. The drain assembly of claim 1, wherein the gasket further includes a third sealing portion spaced apart from the first and second sealing portions, the third sealing portion is engageable with the outer surface of the first tailpipe when the end of the first tailpipe is engaged with the first sealing portion to form a second fluid seal therebetween.

6. The drain assembly of claim 5, wherein the third sealing portion includes at least one sealing rib extending radially inward from an inner wall of the gasket.

7. The drain assembly of claim 5, wherein the third sealing portion includes three sealing ribs extending radially inward from an inner wall of the gasket, and at least one of the three sealing ribs being engageable with the outer surface of the second tailpipe.

8. A drain assembly for connecting an island tub to a drainpipe, the island tub having a first tailpipe with a first outer diameter or a second tailpipe with a second outer diameter that is less than the first outer diameter, the assembly comprising:

(i) a drain body being attachable to and fluidly connectable with the drainpipe, the drain body including:

a body sidewall extending from a first end to a second end, the body sidewall having an inner body surface that extends from the first end to the second end, the inner body surface defining a gasket chamber;

and, a projection that extends radially inward from the body sidewall, the projection defining a bottom end of the gasket chamber, wherein the bottom end includes an opening formed therethrough;

and, (ii) a gasket disposed at least partially within the gasket chamber, the gasket including:

an inner wall extending from a first gasket end to a second gasket end, the inner wall having a first gasket portion and a second gasket portion, the first gasket portion defining a first gasket diameter, and the second gasket portion defining a second gasket diameter that is smaller than the first gasket diameter, wherein the first gasket portion is engageable with an outer surface of the first tailpipe, wherein the second gasket portion is engageable with an outer surface of the second tailpipe and with a terminal end of the first tailpipe, wherein the second gasket portion directly overlies the projection of the drain body such that the second gasket portion, the terminal end of the first tailpipe, and the projection share a common vertically-oriented axis, wherein the second gasket portion further includes an inner sealing edge that extends at least partially through the opening at the bottom end of the gasket chamber.

9. The drain assembly of claim 8, wherein the second gasket portion further includes an inner gasket surface, wherein the inner sealing edge of the second gasket portion defines a gasket opening, and the inner gasket surface of the second gasket portion extends radially outward from the sealing edge, wherein the inner gasket surface of the second gasket portion is engageable with an end of the first tailpipe, and wherein the inner sealing edge is engageable with the outer surface of the second tailpipe.

10. The drain assembly of claim 9, wherein the gasket opening is located at the second gasket end.

11. The drain assembly of claim 8, wherein the inner wall of the first gasket portion defines at least one internal rib that extends radially inward, wherein the at least one internal rib is engageable with the outer surface of the first tailpipe.

12. The drain assembly of claim 11, wherein the at least one internal rib includes a plurality of internal ribs.

13. The drain assembly of claim 12, wherein the plurality of ribs is three ribs.

14. The drain assembly of claim 12, wherein a first of the plurality of internal ribs has a diameter that is less than a diameter of a second of the plurality of internal ribs.

15. A drain assembly for connecting an island tub to a drainpipe, the island tub having a first tailpipe with a first outer diameter or a second tailpipe with a second outer diameter that is less than the first outer diameter, the assembly comprising:

a drain body being attachable to and fluidly connectable with the drainpipe, the drain body including:

a body sidewall extending from a first end to a second end, the body sidewall having an inner body surface that defines a gasket chamber within the drain body, and a projection that extends radially inward from the body sidewall, the projection defining a bottom end of the gasket chamber, wherein the bottom end includes an opening formed therethrough; and a gasket disposed at least partially within the gasket chamber such that a portion of the gasket directly overlies the projection of the drain body and another portion of the gasket extends at least partially through the opening, the gasket being engageable with a terminal end of the first tailpipe to create a fluid seal therebetween and such that the projection, the portion of the gasket that directly overlies the projection, and the terminal end of the first tailpipe share a common vertically-oriented axis, and the gasket being further engageable with an outer surface of the second tailpipe to create a fluid seal therebetween.

16. The drain assembly of claim 15, wherein the gasket includes an inner surface extending from a first gasket end to a second gasket end, wherein the second gasket end is positioned adjacent to the projection, the inner surface defining a first gasket portion and a second gasket portion, the first gasket portion defines a first gasket diameter, and the second gasket portion is L-shaped and defines a second gasket diameter that is less than the first gasket diameter.

17. The drain assembly of claim 16, wherein the L-shaped second gasket portion includes a first sealing portion and a second sealing portion, the first sealing portion defines a gasket opening having the second gasket diameter, and the second sealing portion extends radially outward from the first sealing portion, wherein the second sealing portion is engageable with the end of the first tailpipe and the first sealing portion is engageable with the outer surface of the second tailpipe.

18. The drain assembly of claim 17, wherein the second sealing portion of the second gasket portion is sandwiched between the end of the first tailpipe and the projection of the drain body when the gasket receives the first tailpipe.

19. The drain assembly of claim 17, wherein the first sealing portion of the second gasket portion is sandwiched between the outer surface of the second tailpipe and an edge defining the opening formed in the projection of the drain body when gasket receives the second tailpipe.

20. The drain assembly of claim 17, wherein the first sealing portion is positioned adjacent to an edge defining the opening defined by the projection and the second sealing portion is positioned adjacent to the projection.

21. The drain assembly of claim 17, wherein a portion of the second gasket portion extends at least partially through the opening formed in the projection.

* * * * *